US007850327B2

(12) United States Patent
Campbell et al.

(10) Patent No.: US 7,850,327 B2
(45) Date of Patent: Dec. 14, 2010

(54) APPARATUS, LOGIC AND METHOD FOR EMULATING THE LIGHTING EFFECT OF A CANDLE

(75) Inventors: Kurt Campbell, Cambridge, MA (US); Mike Boone, Los Angeles, CA (US); Mark Medley, Covina, CA (US); Karel Slovacek, Irvine, CA (US)

(73) Assignee: Enchanted Lighting Company, LLC, Azusa, CA (US)

( * ) Notice: Subject to any disclaimer, the term of this patent is extended or adjusted under 35 U.S.C. 154(b) by 1465 days.

(21) Appl. No.: 11/179,062

(22) Filed: Jul. 11, 2005

(65) Prior Publication Data

US 2006/0119287 A1 Jun. 8, 2006

Related U.S. Application Data

(60) Provisional application No. 60/633,496, filed on Dec. 6, 2004, provisional application No. 60/667,717, filed on Mar. 31, 2005.

(51) Int. Cl.
*F21V 9/00* (2006.01)

(52) U.S. Cl. ..... 362/166; 362/161; 362/157; 362/810; 362/811

(58) Field of Classification Search ..... 362/161, 362/159, 166, 392, 409, 415, 810, 806, 811; 315/185 S, 200 A, 247, 246, 209 R, 224, 315/225, 312–326
See application file for complete search history.

(56) References Cited

U.S. PATENT DOCUMENTS 1,736,820 A 11/1929 Black
2,435,811 A 2/1948 Waters
2,509,219 A 4/1948 Desmond et al.
3,749,904 A 7/1973 Graff
3,761,702 A 9/1973 Andeweg
3,762,857 A 10/1973 Andeweg
3,890,085 A 6/1975 Andeweg
4,159,442 A 6/1979 Komatsu
4,218,727 A 8/1980 Shemitz et al.
4,260,365 A 4/1981 Kayne
4,386,392 A 5/1983 Reibling
4,477,249 A 10/1984 Ruzek et al.
4,510,556 A * 4/1985 Johnson ..... 362/184
4,519,556 A 5/1985 Timoschuk
4,567,548 A 1/1986 Schneeberger
4,593,232 A * 6/1986 McEdwards ..... 315/199
4,777,408 A 10/1988 DeLuca
4,866,580 A 9/1989 Blackerby
5,097,180 A 3/1992 Ignon et al.

(Continued)

FOREIGN PATENT DOCUMENTS

CA 1136106 11/1982

(Continued)

*Primary Examiner*—Tuyet Thi Vo
(74) *Attorney, Agent, or Firm*—Blakely, Sokoloff, Taylor & Zafman LLP

(57) ABSTRACT

According to one embodiment of the invention, a method comprises receiving a time-varying power waveform. The power waveform may be periodic and/or phase-controlled. Compressed within a power range associated with the time-varying power waveform, a pulse width modulated (PWM) signal is produced, which is supplied to a light source in order to produce a lighting effect emulating lighting from a candle flame.

25 Claims, 15 Drawing Sheets

U.S. PATENT DOCUMENTS

| | | | |
|---|---|---|---|
| 5,152,602 | A | 10/1992 | Boschetto |
| 5,440,456 | A | 8/1995 | Bertling et al. |
| 5,658,073 | A | 8/1997 | Lee |
| 5,690,484 | A | 11/1997 | Leonard et al. |
| D394,513 | S | 5/1998 | Davis |
| 5,863,108 | A | 1/1999 | Lederer |
| D406,365 | S | 3/1999 | Furner |
| 5,876,706 | A | 3/1999 | Zaunbrecher |
| 5,879,151 | A | 3/1999 | Schultz et al. |
| 5,896,497 | A | 4/1999 | Halstead |
| D409,316 | S | 5/1999 | Majerowski |
| D410,096 | S | 5/1999 | Majerowski |
| 5,919,423 | A | 7/1999 | Requejo et al. |
| 5,924,784 | A | 7/1999 | Chliwnyj et al. |
| 5,939,005 | A | 8/1999 | Materna |
| 5,951,153 | A | 9/1999 | Favela |
| 5,955,034 | A | 9/1999 | Zaunbrecher et al. |
| D417,018 | S | 11/1999 | Soller |
| 5,980,064 | A | 11/1999 | Metroyanis |
| 6,013,231 | A | 1/2000 | Zaunbrecher et al. |
| 6,017,139 | A | 1/2000 | Lederer |
| 6,019,804 | A | 2/2000 | Requejo et al. |
| 6,036,925 | A | 3/2000 | Adams et al. |
| 6,053,622 | A | 4/2000 | Horowitz et al. |
| D429,828 | S | 8/2000 | Schultz et al. |
| 6,106,786 | A | 8/2000 | Akahoshi |
| 6,198,229 | B1 | 3/2001 | McCloud et al. |
| 6,241,362 | B1 | 6/2001 | Morrison |
| 6,309,092 | B1 | 10/2001 | Bardeen et al. |
| 6,361,192 | B1 | 3/2002 | Fussell et al. |
| 6,554,447 | B1 | 4/2003 | Kotary et al. |
| 6,616,308 | B2 | 9/2003 | Jensen et al. |
| 6,685,345 | B1 | 2/2004 | Velasquez |
| 6,719,443 | B2 | 4/2004 | Gutstein et al. |
| 6,769,905 | B2 | 8/2004 | Gray et al. |
| D502,559 | S | 3/2005 | Delcourt |
| 6,926,423 | B2 | 8/2005 | Bucher |
| 6,957,906 | B2 | 10/2005 | Coushaine et al. |
| 6,963,180 | B2 | 11/2005 | Rose |
| 7,093,949 | B2 | 8/2006 | Hart et al. |
| 7,093,961 | B2 | 8/2006 | Bentley et al. |
| 7,098,600 | B2 | 8/2006 | Li et al. |
| D530,838 | S | 10/2006 | Adams |
| 7,121,686 | B1 | 10/2006 | Chu |
| 7,125,142 | B2 | 10/2006 | Wainwright |
| 7,132,084 | B1 | 11/2006 | Roumpos |
| D533,951 | S | 12/2006 | Adams |
| D533,952 | S | 12/2006 | Adams et al. |
| D534,282 | S | 12/2006 | Adams et al. |
| D534,283 | S | 12/2006 | Adams et al. |
| D534,666 | S | 1/2007 | Adams et al. |
| D538,450 | S | 3/2007 | Adams et al. |
| D541,443 | S | 4/2007 | Adams et al. |
| 7,201,500 | B2 | 4/2007 | Mlshan |
| D546,481 | S | 7/2007 | Adams et al. |
| 7,350,720 | B2 | 4/2008 | Jaworski et al. |
| 7,410,269 | B2 | 8/2008 | Harrity et al. |
| RE040,934 | E | 10/2009 | Ruud et al. |
| 2002/0080604 | A1 | 6/2002 | Niermann |
| 2002/0093834 | A1 | 7/2002 | Yu et al. |
| 2003/0035291 | A1 | 2/2003 | Jensen et al. |
| 2005/0169666 | A1 | 8/2005 | Porchia et al. |
| 2005/0169812 | A1 | 8/2005 | Helf et al. |
| 2005/0196716 | A1* | 9/2005 | Haab et al. ..... 431/126 |

FOREIGN PATENT DOCUMENTS

| | | | |
|---|---|---|---|
| CA | 2262338 | | 8/2000 |
| CA | 2456160 | | 2/2003 |
| CN | 2637894 | Y | 9/2004 |
| CN | 2778820 | Y | 5/2006 |
| CN | 2795654 | Y | 7/2006 |
| CN | 2854329 | Y | 1/2007 |
| CN | 2854337 | Y | 1/2007 |
| CN | 2905792 | Y | 5/2007 |
| CN | 2906311 | Y | 5/2007 |
| EP | 0137654 | | 4/1985 |
| EP | 0600217 | | 6/1994 |
| EP | 0916892 | | 5/1999 |
| EP | 1419345 | | 5/2004 |
| FR | 2447516 | | 8/1980 |
| FR | 2788101 | | 7/2000 |
| GB | 191224971 | | 12/1913 |
| GB | 498857 | | 1/1939 |
| GB | 499745 | | 1/1939 |
| GB | 588801 | | 6/1947 |
| GB | 700279 | | 11/1953 |
| GB | 2103777 | | 2/1983 |
| GB | 2110810 | | 6/1983 |
| GB | 2357829 | | 7/2001 |
| JP | 11299529 | | 11/1999 |
| SE | 523145 | | 3/2004 |

* cited by examiner

FIG. 1
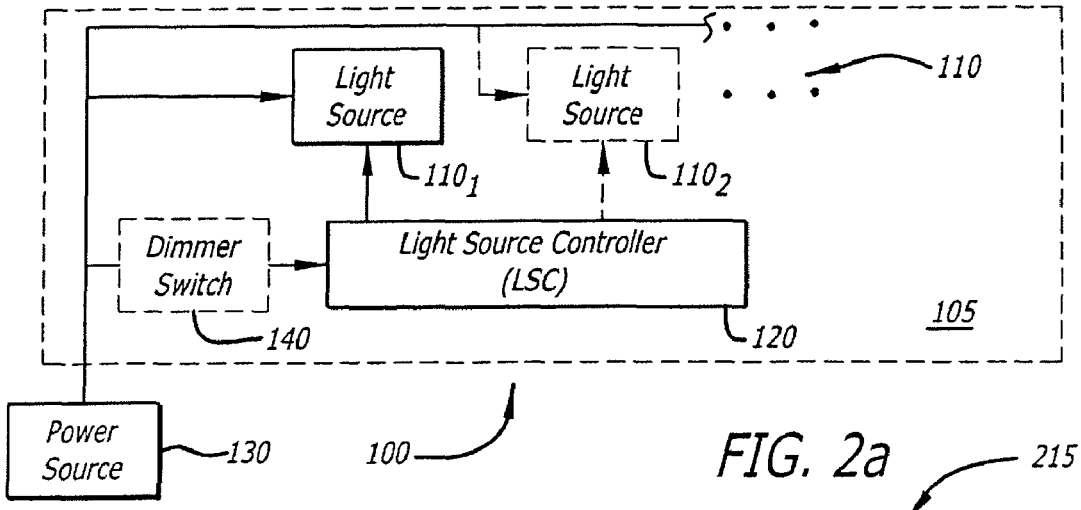
FIG. 2a
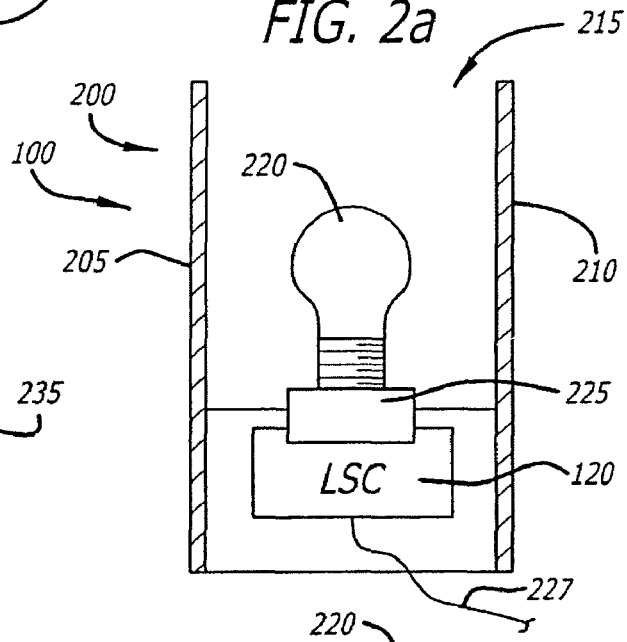
FIG. 2b
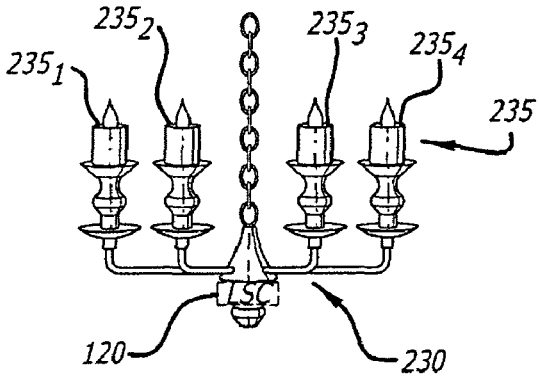
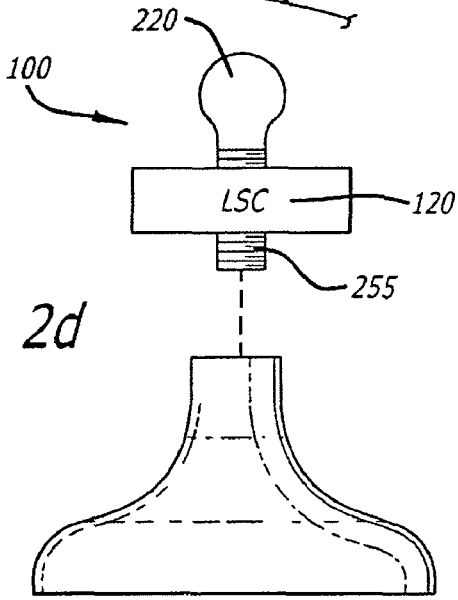
FIG. 2d
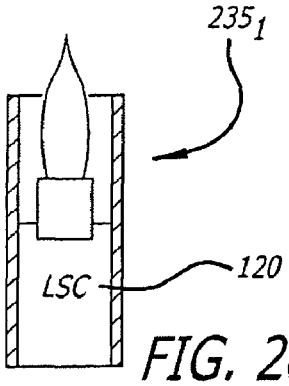
FIG. 2c

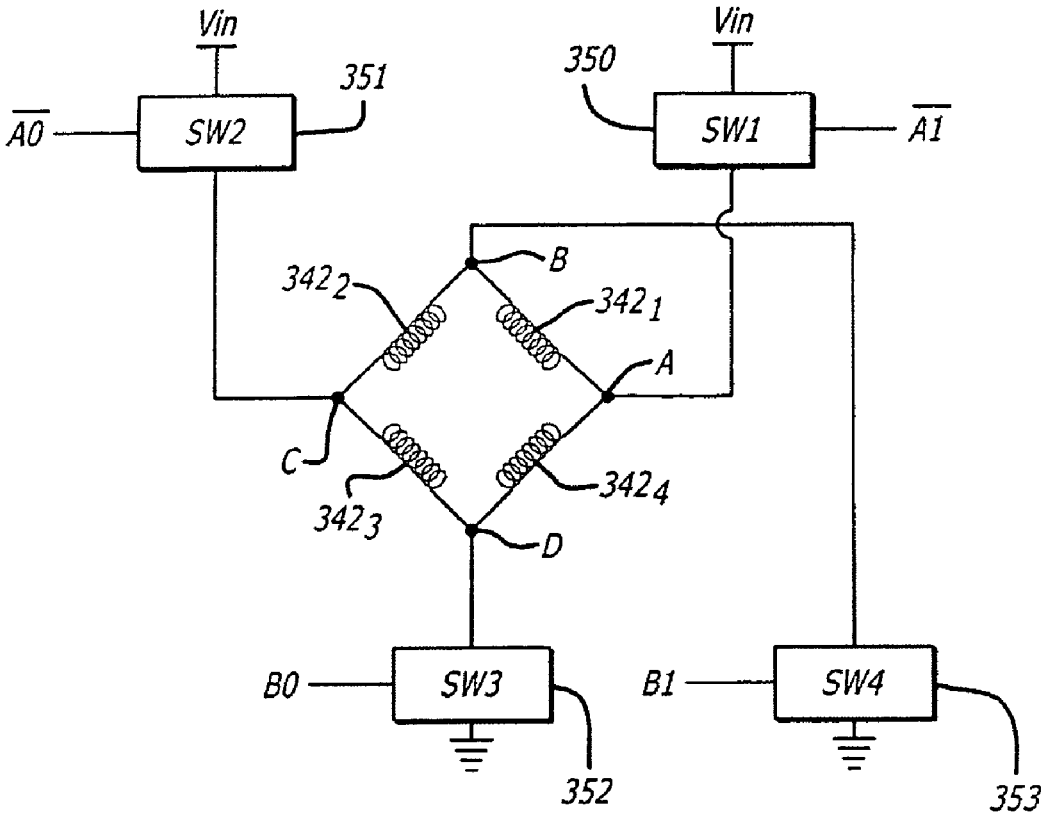
FIG. 3E
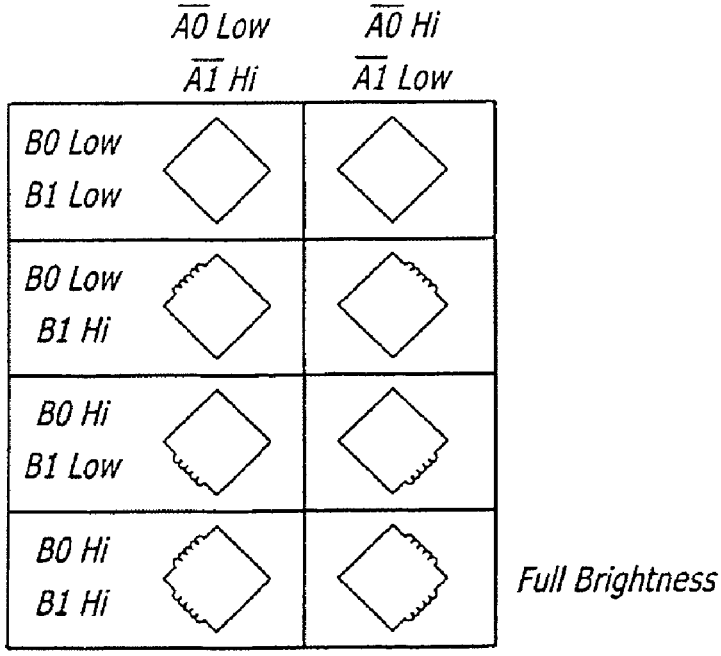

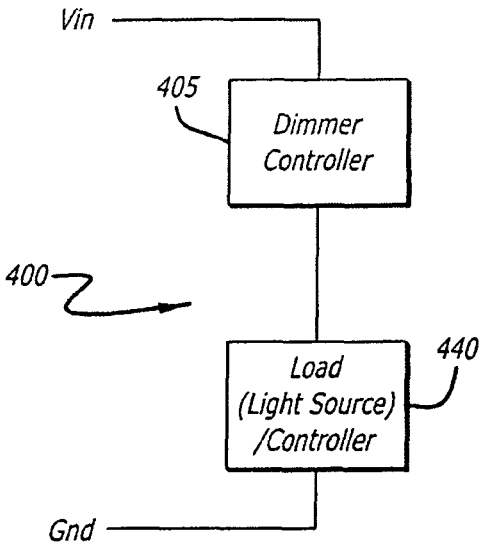
FIG. 4A
FIG. 4B
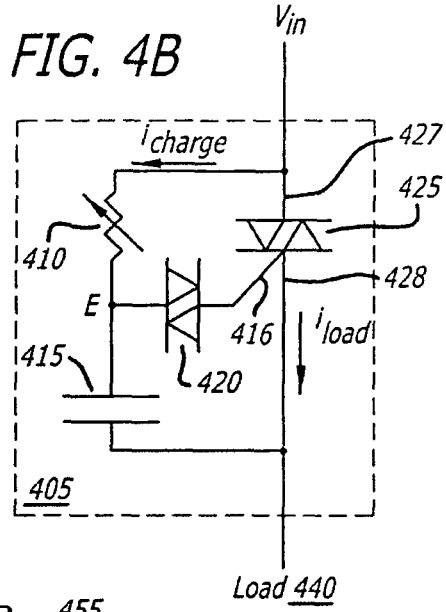
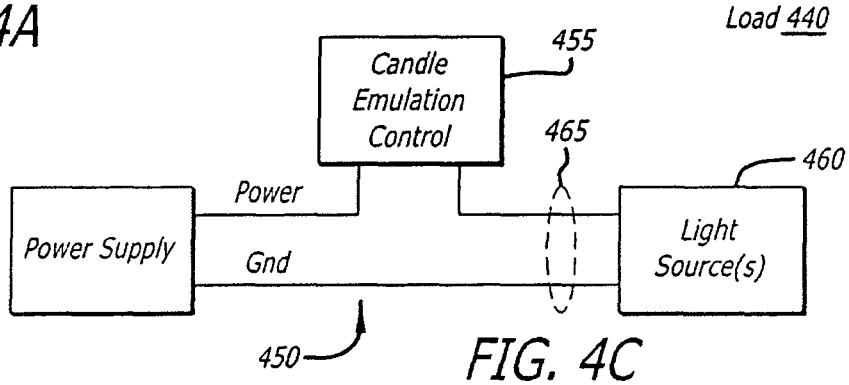
FIG. 4C
FIG. 5
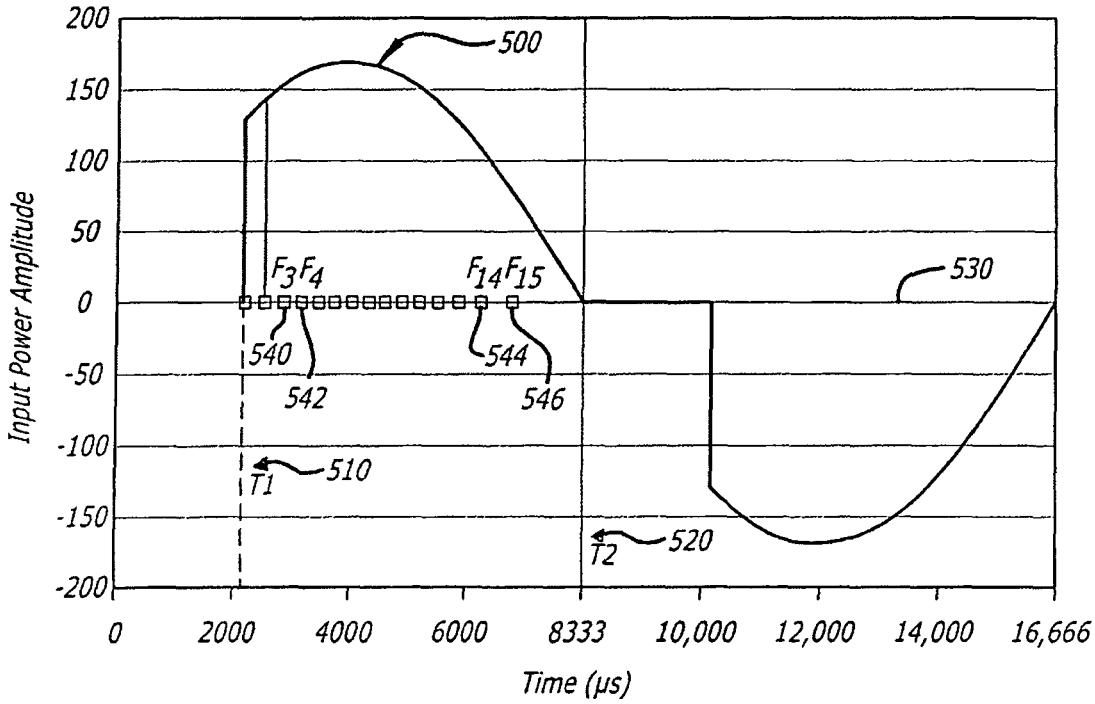

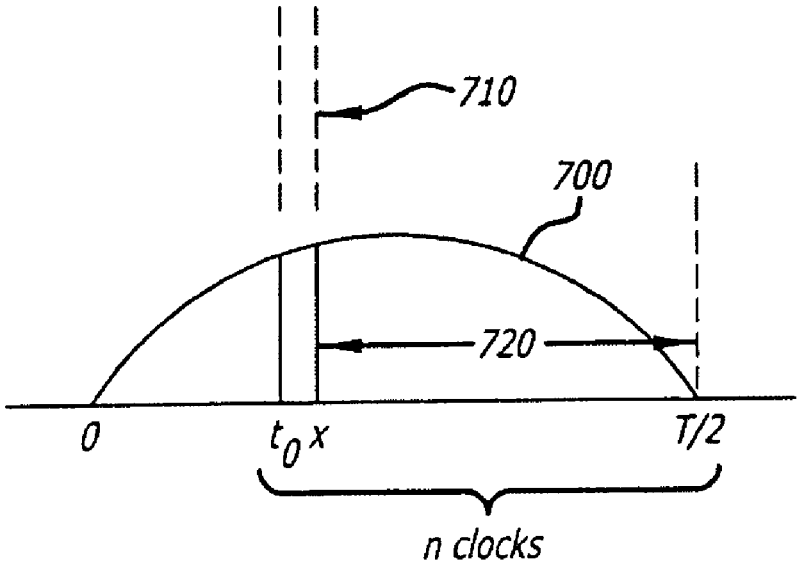

$$\int_{t_0}^{x} \sin(\omega t)\,dt = \frac{1}{n}\int_{t_0}^{T/2} \sin(\omega t)\,dt$$

$$\Rightarrow \frac{-1}{\omega}\cos(\omega x) + \frac{1}{\omega}\cos(\omega t_0) = \frac{-1}{n\omega}\cos(\omega T/2) + \frac{1}{n\omega}\cos(\omega t_0)$$

$$= \frac{1}{n\omega}\cos(\omega t_0) + \frac{1}{n\omega}$$

$$\Rightarrow \cos(\omega x) = \left(1 - \frac{1}{n}\right)\cos(\omega t_0) - \frac{1}{n}$$

$$x = \frac{1}{\omega}\,\mathrm{acos}\left[\left(\frac{n-1}{n}\right)\cos(\omega t_0) - \frac{1}{n}\right]$$

FIG. 7

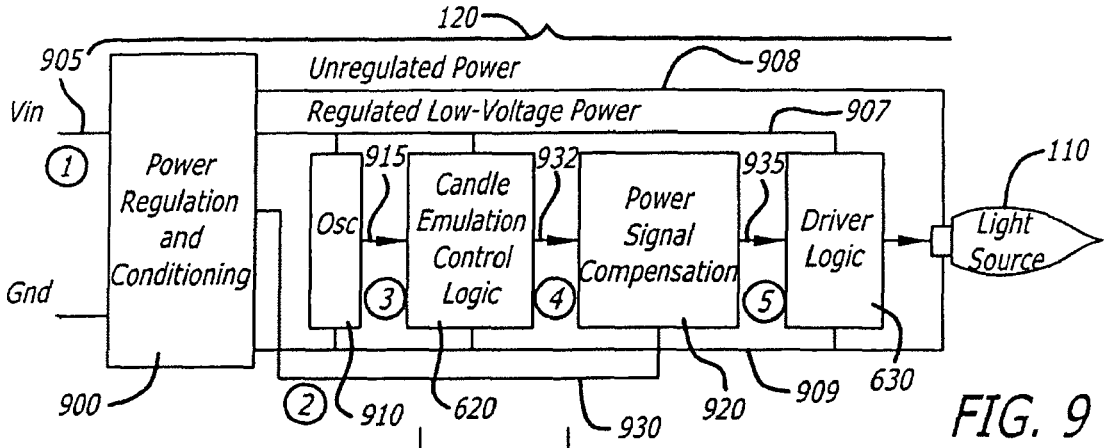
FIG. 9
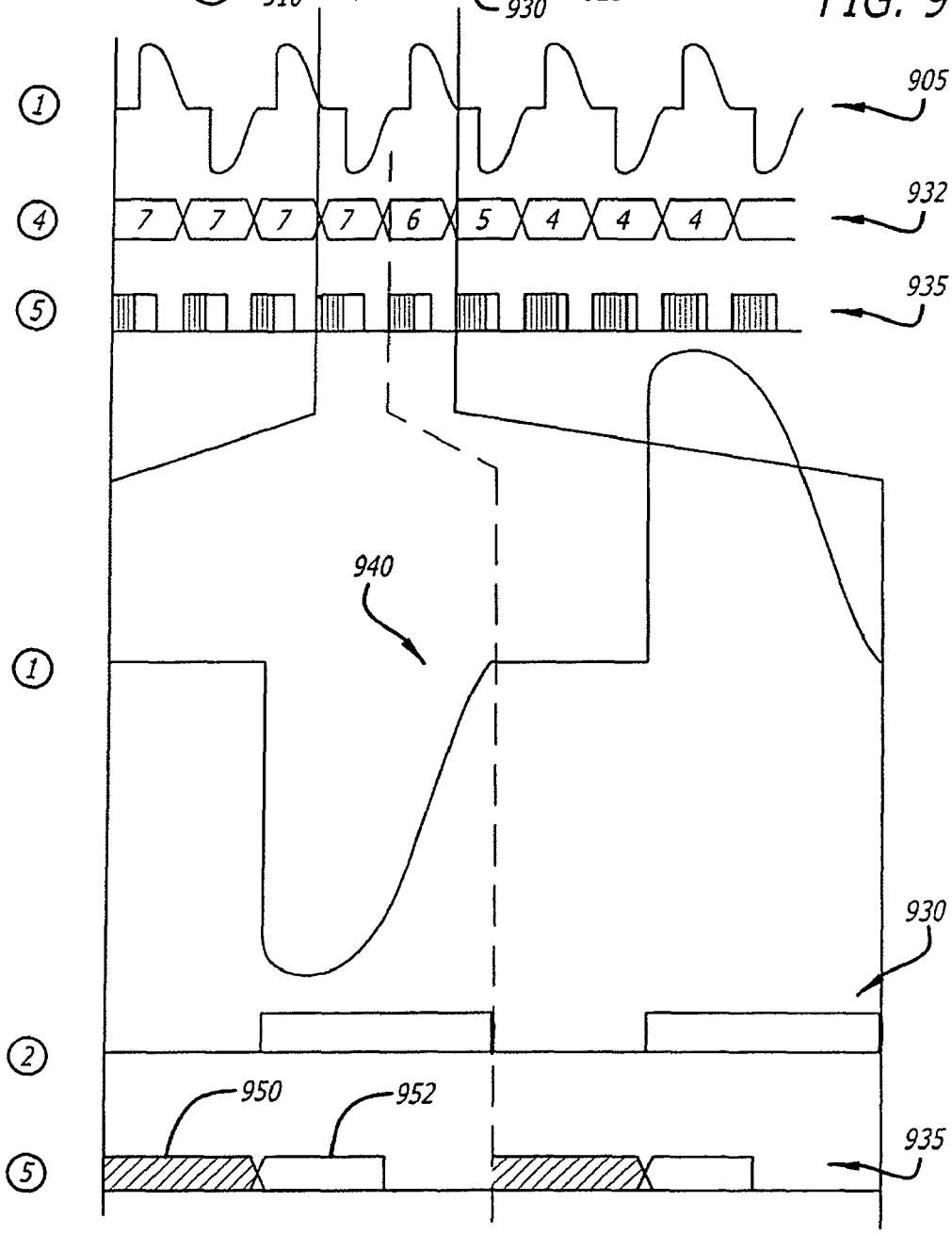

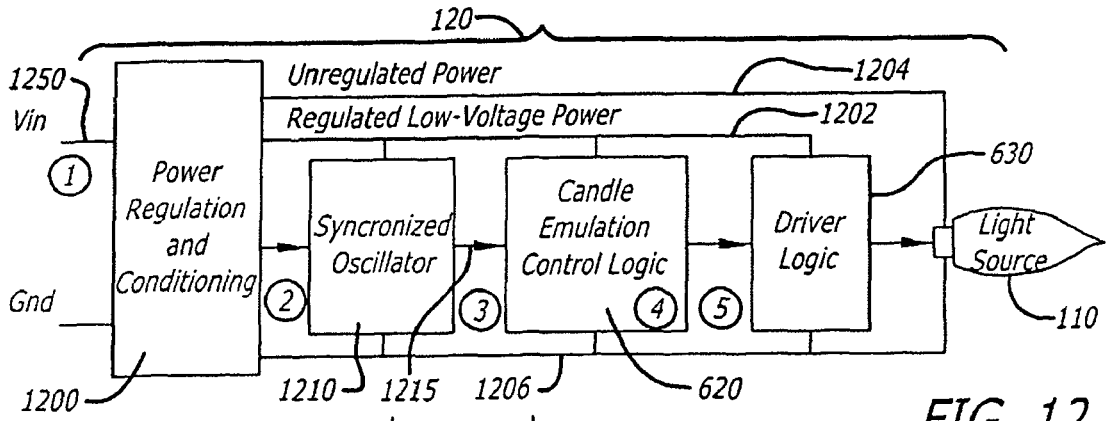
FIG. 12
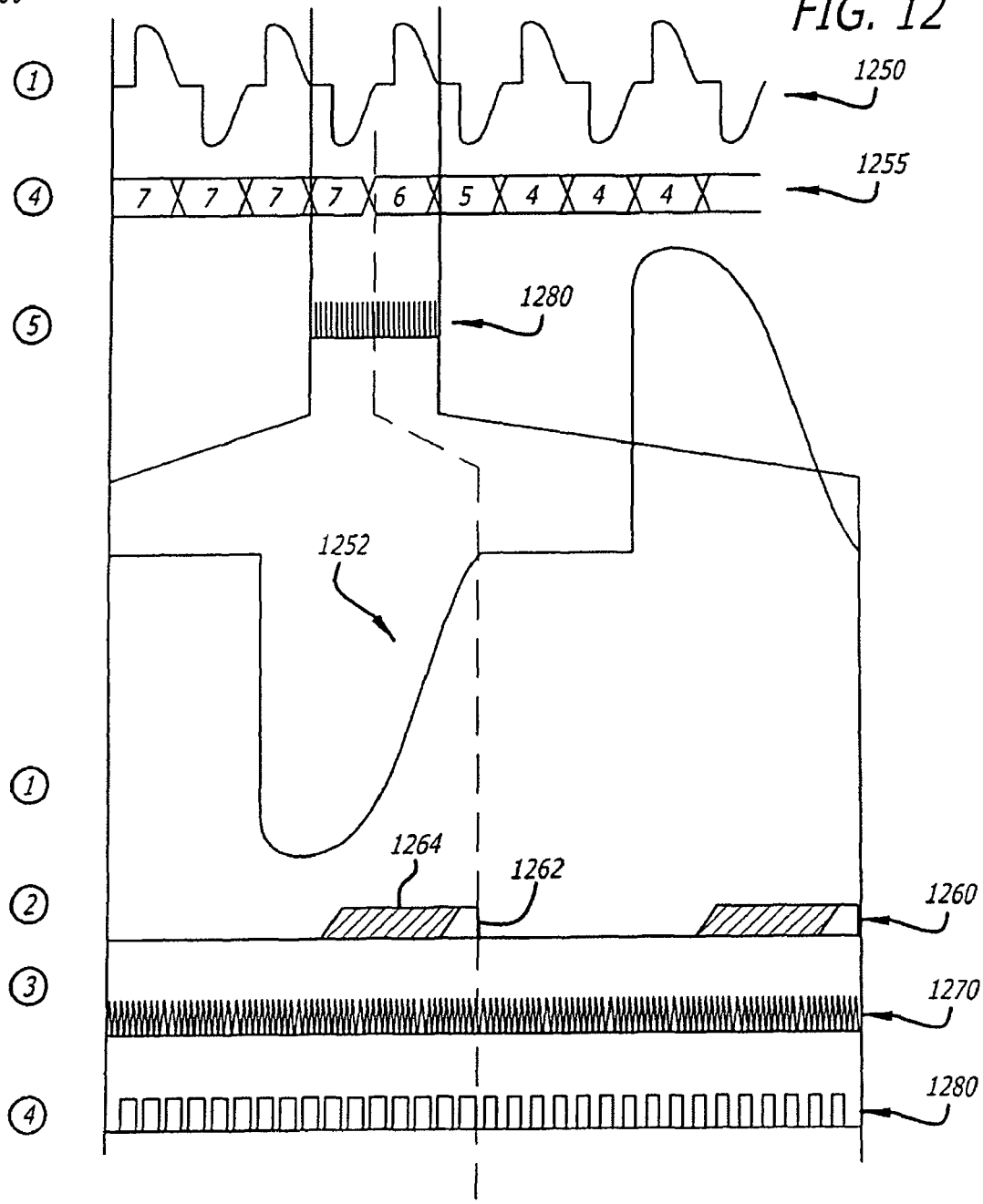

APPARATUS, LOGIC AND METHOD FOR EMULATING THE LIGHTING EFFECT OF A CANDLE

CROSS-REFERENCES TO RELATED APPLICATIONS

This application claims the benefit of priority on U.S. Provisional Application No. 60/633,496 filed Dec. 6, 2004 and U.S. Provisional Application No. 60/667,717 filed Mar. 31, 2005.

FIELD

Embodiments of the invention relate to the field of lighting, in particular, to candle emulation.

GENERAL BACKGROUND

For centuries, wax candles have been used to provide lighting for all types of dwellings. Over the last thirty years, however, wax candles have mainly been used as decorative lighting or as subdued lighting for mood-setting purposes. For instance, restaurants use wax candles as decorations in order to provide a more intimate setting for their patrons. Individuals purchase wax candles for placement around their home to provide a festive or relaxing environment for their guests.

There are a few disadvantages with wax candles. One disadvantage is that they are costly to use when considering operational costs ($/usage time). In addition to their high cost, wax candles with open flames pose a risk of fire when left unattended for a period of time. These candles also pose a risk of harm to small children who do not understand the dangers of fire.

Accordingly, for cost savings and safety concerns, in certain situations, it would be beneficial to substitute a wax candle for a candle emulation device. Unfortunately, most candle emulation devices do not accurately imitate the lighting effect of a flickering candle, namely a realistic flickering light pattern. For usage by restaurants, this may leave an unfavorable impression by patrons of a restaurant. For usage at home, it may not provide the overall mood-setting effect that the user has tried to create.

BRIEF DESCRIPTION OF THE DRAWINGS

The invention may best be understood by referring to the following description and accompanying drawings that are used to illustrate embodiments of the invention.

FIG. 1 is an exemplary block diagram of a candle emulation device employing the present invention.

FIG. 2A is a first exemplary embodiment of the candle emulation device of FIG. 1.

FIG. 2B is a second exemplary embodiment of the candle emulation device of FIG. 1.

FIG. 2C is a third exemplary embodiment of the candle emulation device of FIG. 1.

FIG. 2D is a fourth exemplary embodiment of the candle emulation device of FIG. 1.

FIG. 3E is a first exemplary schematic diagram of a multi-filament incandescent bulb of FIG. 3A or 3C with each of the four filament segments independently controlled.

FIG. 4A is an exemplary embodiment of a dimmer switch adapted to control the light source in order to emulate a flickering candle.

FIG. 4B is a first exemplary embodiment of the internal components forming the dimmer switch of FIG. 4A.

FIG. 4C is a second exemplary embodiment of the dimmer switch adapted to control the light source in order to emulate a flickering candle.

FIG. 5 is an exemplary embodiment of an input power waveform provided to the dimmer switch of FIGS. 4B or 4C.

FIG. 7 is a first exemplary embodiment of the operations performed by the power signal modulated clock of FIG. 6.

FIG. 9 is a second exemplary embodiment of the light source controller operating with the dimmer control to control the light source in order to emulate a flickering candle and the signaling received and produced by the light source controller.

FIG. 12 is a third exemplary embodiment of the light source controller operating with the dimmer control to control the light source in order to emulate a flickering candle and the signaling received and produced by the light source controller.

DETAILED DESCRIPTION

Figure 3A:
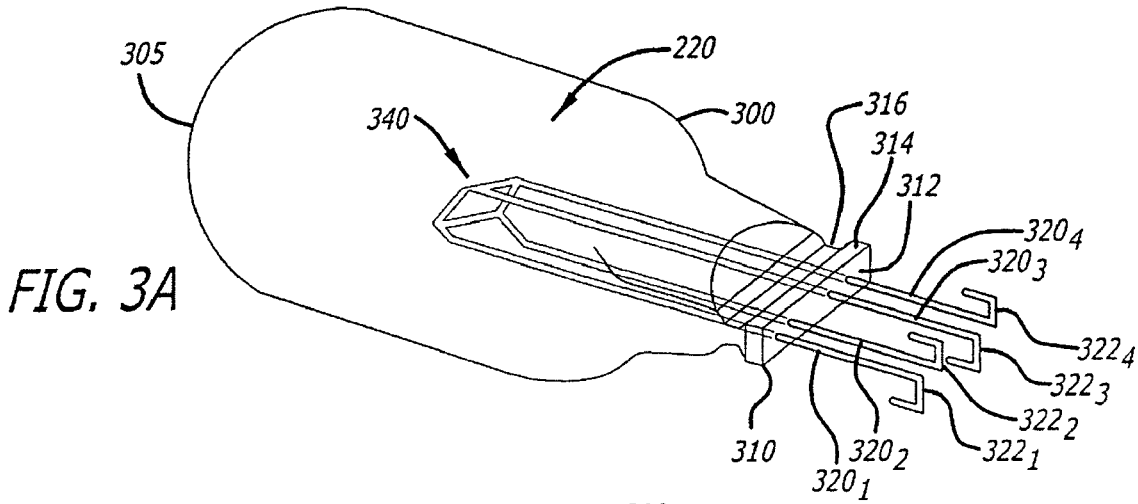
FIG. 3A is a first exemplary embodiment of a light source represented as an incandescent bulb featuring staggered electrical feedthroughs and operating as a light source for the candle emulation device of FIG. 1.

Herein, certain embodiments of the invention relate to an apparatus, logic and method for electrically emulating lighting from a candle flame. For instance, one aspect is taking a phase controlled, time-varying (e.g., periodic) power waveform, such as an output of a dimmer switch for example, and applying a fixed or adjusting pulse width modulated frame that is compressed within the available power or voltage in order to control a light source such as an incandescent light bulb for example.

Herein, certain details are set forth below in order to provide a thorough understanding of various embodiments of the invention, albeit the invention may be practiced through many embodiments other than those illustrated. Well-known components and operations are not set forth in detail in order to avoid unnecessarily obscuring this description.

In the following description, certain terminology is used to describe features of the invention. For example, the term "lighting fixture" is generally defined as any device that provides illumination based on electrical input power, where as described below, a "candle emulation device" is merely a lighting fixture providing illumination that emulates the lighting effect of a candle. Examples of various types of lighting fixtures include, but are not limited or restricted to a lamp, a table lamp featuring a pillar or tapered candle housing, a sconce, chandelier, lantern, or the like. Moreover, a "component" or "logic" is generally defined as hardware and/or software, which may be adapted to perform one or more operations on an incoming signal. Examples of types of incoming signals include, but are not limited or restricted to power waveforms, clock, pulses, or other time-varying signals. Also, the term "translucent material" is generally defined as any composition that permits the passage of light. Most types of translucent material diffuse light. However, some types of translucent material may be transparent in nature.

Referring to FIG. 1, an exemplary block diagram of a candle emulation device employing the present invention is illustrated. Candle emulation device 100 comprises one or more light sources $\mathbf{110}_1, \ldots,$ and/or $\mathbf{110}_N$ ($N \geqq 1$), generally referred to as "light source 110," controlled by a light source controller (LSC) 120 positioned within a housing 105.

Light source 110 and light source controller 120 are supplied power by a power source 130, such as line voltage (e.g., ranging between approximately 110-220 volts in accordance with U.S. and International power standards, such as 110 voltage alternating current "VAC" at 50 or 60 Hertz "Hz", 220 VAC at 50 or 60 Hz, etc.) supplied from a wall socket. Alternatively, power source 130 may be any number of other power supplying mechanisms such as a transformer that supplies low voltage power (12 VAC) for example. As illustrated, power source 130 may be situated external to housing 105 of candle emulation device 100 or, in certain embodiments, may be placed internally therein.

According to one embodiment of the invention, each light source 110 is a single incandescent light bulb that may be electrically coupled to light source controller 120. Exemplary light sources are illustrated in FIGS. 3A-3I and described below.

Although not shown in FIG. 1, according to one embodiment of the invention, light source controller 120 comprises a circuit board featuring power regulation and conditioning logic, candle emulation control logic and driver logic. The power regulation and conditioning logic is configured to provide regulated, local power from an unregulated input power supplied by power source 130. The regulated local power is supplied to other components within light source controller 120 such as the candle emulation control logic and the driver logic. The candle emulation control logic is adapted to create a realistic candle lighting pattern. The driver logic is adapted to mechanically connect with and drive (activate/deactivate) light source 110. The operation of these components will be described in detail below.

Alternatively, it is contemplated that light source controller 120 may comprise multiple circuit boards with a primary circuit board adapted for power regulation and supplying regulated power to one or more secondary circuit boards responsible for controlling light source 110. As one example, a secondary circuit board may be adapted to control a single light source $\mathbf{110}_1$ or multiple light sources $\mathbf{110}_1$ and $\mathbf{110}_2$. As another example, one secondary circuit board may be adapted to control a light source $\mathbf{110}_1$ while another secondary circuit board may be adapted to control a different light source $\mathbf{110}_2$, and the like.

It is contemplated that light source controller 120 may be adapted with a first connector designed so that light source 110 may be removed and replaced with a different light source. Similarly, light source controller 120 may be adapted with a second connector designed so that either light source controller 120 or power source 130 may be removed and replaced as needed.

It is further contemplated that a control unit 140, optionally shown by dashed lines, may be adapted to cooperate with light source controller 120 to control the illumination of candle emulation device 100 of FIG. 1. For such an embodiment, control unit 140 is a dimmer switch 140 may situated within housing 105 or external to housing 105. It is contemplated, however, that control unit 140 may be a light switch, a photocell, a timer or any unit for controlling an illumination output of light source 110.

Referring now to FIG. 2A, a first exemplary embodiment of candle emulation device 100 of FIG. 1 is shown. Candle emulation device 100 is illustrated as one type of lighting fixture, namely a table lamp including a pillar or tapered candle housing 200 featuring translucent side walls 205 and 210 as well as an uncovered top 215. Light from an incandescent light bulb 220, one embodiment of light source 110 of FIG. 1, casts shadows replicating lighting from a candle flame. Translucent side walls 205 and 210 may form part of a polyurethane candle shell having a smooth, textured drippy or otherwise aesthetically pleasing outer surface. Alternatively, translucent sidewalls 205 and 210 may be any other type of translucent material such as a natural or synthetic cloth, paper, plastic, glass, or other suitable material.

A connector 225 is configured as an interface for mating with a complementary base of incandescent light bulb 220, which provides electrical connectivity between incandescent light bulb 220 and light source controller 120. A detailed illustration of one embodiment of the base of incandescent light bulb 220 is shown in FIG. 3B, where connector 225 would be configured as a socket.

Normally, the power source would be featured outside of pillar candle housing 200 and power supplied via a power line 227. However, it is contemplated that power source 130 could be implemented within housing 200 as an alternative embodiment.

Referring to FIG. 2B, a second exemplary embodiment of the candle emulation device of FIG. 1 is shown. Candle emulation device 100 is illustrated as a chandelier that comprises a frame 230 for supporting multiple light sources $\mathbf{235}_1$-$\mathbf{235}_M$ ($M \geqq 1$), generally referred to as "light sources 235". According to one embodiment, light sources 235 may be centrally controlled by light source controller 120 placed within an interior of frame 230 and routing power received from an external power source. However, according to another embodiment illustrated in FIG. 2C, each of the light sources 235 may be controlled in a decentralized fashion, where multiple light source controllers are placed within the housing of each corresponding light source $235_1, \ldots$, and $235_M$ or within frame 230 proximate to each corresponding light source $235_1, \ldots$, and $235_M$.

Referring to FIG. 2D, a fourth exemplary embodiment of candle emulation device 100 of FIG. 1 is shown. Configured as part of a single, removable light source 250, candle emulation device 100 comprises an Edison base 255 for rotational coupling to a lamp, desk light, sconce, or other lighting fixture. Candle emulation device 100 comprises light source controller 120, which is electrically coupled to both base 255 and incandescent bulb 220 and controls incandescent bulb 220 to provide a lighting effect that emulates a candle flame. It is contemplated that base 255 may be a small, medium or large Edison base, bi-pin base, or any other commonly used light bulb base, which might be adapted for use with candle emulation device 100.

Figure 3B:
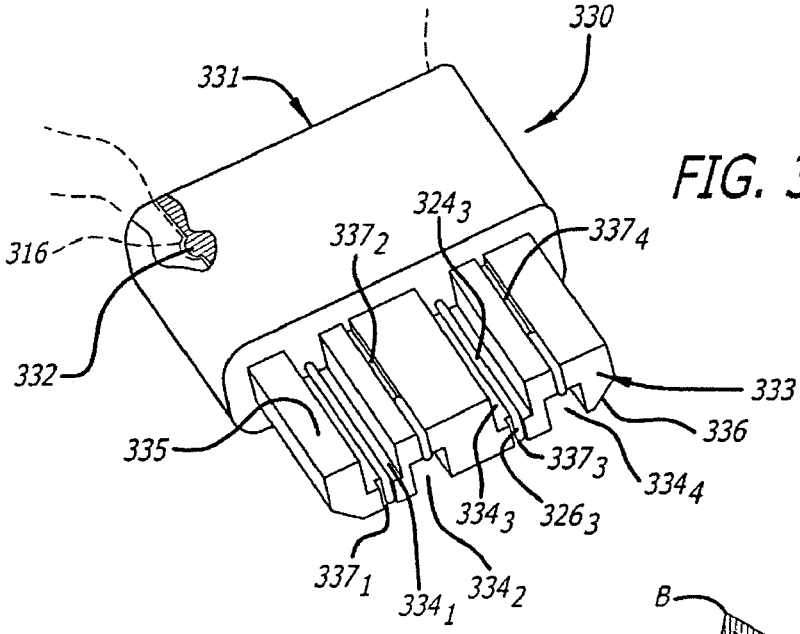
FIG. 3B is an exemplary embodiment of a base of the incandescent bulb of FIG. 3A.

Referring now to FIG. 3A, an exemplary embodiment of a light source represented as an incandescent light bulb 220 featuring staggered electrical feedthroughs $320_1$-$320_R$ ($R \geqq 2$) and operating as light source $110_1$ for candle emulation device 100 of FIG. 1 is shown. When used with 120 VAC input power, for example, incandescent light bulb 220 might be configured with one or more 60-120 VAC filaments that are designed to operate at approximately 50/50 duty cycle (e.g., during only one-half wave of the AC power cycle) and are controlled to provide a stable, low wattage incandescent light to emulate lighting from a candle flame. Designing the filaments to a lower voltage allows the use of lower wattage filaments that are more mechanically stable and easier to manufacture.

Incandescent light bulb 220 comprises a bulb housing 300 made of glass or high temperature plastic that surrounds one or more filaments 340. Bulb housing 300 features a closed first end 305 and a second end 310 featuring an opening 312 through which multiple feedthroughs $320_1$-$320_R$ extend. Second end 310 of bulb housing 300 features an elongated protrusion 314 formed at a perimeter of opening 312 to create a channel 316. Channel 316 provides an interlocking mechanism for a base 330 as shown in FIG. 3B.

Each "feedthrough" $320_1$-$320_R$ is an electrical lead line extending from second end 310 and coupled to filament 340 within bulb housing 300. For this embodiment of the invention, four feedthroughs $320_1$-$320_4$ are arranged in a staggered orientation with ends $322_1$ and $322_3$ of first and third feedthroughs $320_1$ and $320_3$ having a first curvature and ends $322_2$ and $322_4$ of second and fourth feedthroughs $320_2$ and $320_4$ having a second curvature. The second curvature may be in a direction consistent with or opposite from the first curvature as shown.

According to one embodiment of the invention, as shown in FIG. 3B, base 330 comprises first end 331 and a second end 333. First end 331 features a protrusion 332 that, when second end 310 of bulb 300 is inserted into base 330, interlocks with channel 316. Of course, it is contemplated that base 330 may be structured in a configuration other than a rectangular form factor, such as a generally circular configuration as shown in FIG. 3C.

Second end 333 of base 330 comprises a first plurality of grooves $334_1$-$334_4$ alternatively positioned on a top and bottom surfaces 335 and 336 of base 330. A corresponding plurality of grooves $337_1$-$337_4$, having a lesser width than first plurality of grooves $334_1$-$334_4$, are alternatively positioned on bottom and top surfaces 336 and 335 of base 330. This alternative groove construction exposes multiple sides of ends $322_1$-$322_4$ of feedthroughs $320_1$-$320_4$ to increase contact area and enable polarizing of base 330. This increased contact area provides better connectivity with a corresponding connector for light source controller 120.

More specifically, as shown, each groove (e.g., groove $334_3$) is offset from neighboring grooves $334_2$ and $334_4$ so that a first segment $324_3$ of feedthrough $320_3$ is exposed. A second segment $326_3$ of feedthrough $320_2$ is accessible within groove $337_3$.

Figure 3C:
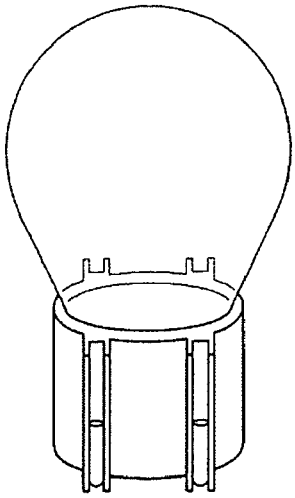
FIG. 3C is a second exemplary embodiment of a light source represented as an incandescent bulb.
Figure 3D:
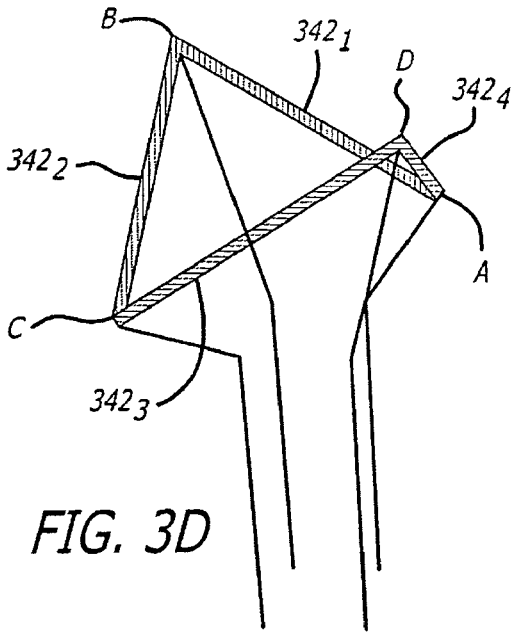
FIG. 3D is an exemplary embodiment of independently controlled filament construction for the incandescent bulb of FIG. 3A or 3C.

FIG. 3D is an exemplary embodiment of independently controlled, multi-filament incandescent light bulb 220 of FIG. 3A or 3C. Herein, four filament segments $342_1$-$342_4$ are arranged in an electrically continuous polygon shape and are independently controlled through feedthroughs $320_1$-$320_4$, respectively. It is contemplated that fewer or more than four segments may be arranged with a corresponding number of feedthroughs. These feedthroughs $320_1$-$320_4$ are attached to intersection points A-D of filament segments $342_1$-$342_4$. Filament segments $342_1$-$342_4$ may be separate filaments or sections of a single filament.

According to one embodiment of the invention, each filament segment $342_1, \ldots$, or $342_4$ is designed to operate at full brightness at 50% duty cycle. For example, filament segment $342_1$ may be a 60 VAC filament that is operating at full power and 50/50 duty cycle (e.g., turned on for one-half wave of a 120 VAC power cycle for this embodiment). However, it is contemplated that other duty cycles may be used. For instance, opposite filament segments $342_1$ and $342_3$ (or $342_2$ and $342_4$) may be configured with different duty cycles summing to 100% duty cycle (e.g., filament segment $342_1$ at 70% duty cycle and filament segment $342_1$ at 30% duty cycle; filament segment $342_2$ at 80% duty cycle and filament segment $342_4$ at 20% duty cycle, etc.) or with collective duty cycles slightly exceeding 100% (e.g., filament segment $342_1$ at 60% duty cycle and filament segment $342_1$ at 60% duty cycle; filament segment $342_2$ at 55% duty cycle and filament segment $342_4$ at 60% duty cycle, etc.).

FIG. 3E is a first exemplary schematic diagram of a multi-filament incandescent bulb 220 of FIG. 3A or 3C with each of the four filament segments $342_1, \ldots$, and $342_4$ independently controlled. Feedthroughs $320_1$-$320_4$ are coupled at points of intersection for various filament segments; namely, intersection point A is between filament segments $342_1$ and $342_4$, intersection point B is between filament segments $342_1$ and $342_2$, intersection point C is between filament segments $342_2$ and $342_3$, and intersection point D is between filament segments $342_3$ and $342_4$.

According to this embodiment of the invention, one end of first filament segment $342_1$ is coupled to receive input power ($V_{in}$) when a first switching element 350 (e.g., p-channel transistor) is active (closed). The other end of first filament segment $342_1$ is coupled to ground (GND) when a fourth switching element 353 (e.g., n-channel transistor) is active. Hence, first filament segment $342_1$ is illuminated when switch input ($\overline{A1}$) is logic low and switch input B1 is logic high.

Similarly, a first end of second filament segment $342_2$ is coupled to GND when fourth switching element 353 is active. A second end of second filament segment $342_2$ is coupled to $V_{in}$ when a second switching element 351 (e.g., p-channel transistor) is active. This is accomplished when a switch input ($\overline{A0}$) is logic low and switch input B1 is logic high.

As further shown, a first end of third filament segment $342_3$ is coupled to $V_{in}$ when second switching element 351 is active (closed). A second end of third filament segment $342_3$ is coupled to GND when a third switching element 352 (e.g., n-channel transistor) is active. Hence, third filament segment $342_3$ is illuminated when switch input ($\overline{A0}$) is logic low and switch input B0 is logic high.

In addition, a first end of fourth filament segment $342_4$ is coupled to GND when third switching element 352 is active. A second end of fourth filament segment $342_4$ is coupled to $V_{in}$ when first switching element 350 is active. This is accomplished when a switch input ($\overline{A0}$) is logic low and switch input B0 is logic high.

Hence, as shown in the operational table of FIG. 3E, each column represents a selected time portion of a power wave cycle that can be used for independent, pulse width modulation control of all filament segments $342_1$-$342_4$. For instance, as an example, for input power (e.g., 110-220 volt input such as 110 VAC@60 Hz) at 50% duty cycle, filament segments $342_2$ and/or $342_3$ may operate at 50/50 duty cycle (e.g., powered during a first half of the power cycle) and filament segments $342_1$ and/or $342_4$ may operate at 50/50 duty cycle (e.g., powered during a second half of the power cycle).

For instance, for this embodiment, during the first half of the power cycle, filament segment $342_2$ may be powered a certain percentage of the total cycle time and filament segment $342_3$ may be powered a certain percentage, where these percentages do not have to be equal. Similarly, during the second half of the power cycle, filament segment $342_1$ may be powered a certain percentage of the total cycle time and filament segment $342_4$ may be powered a certain percentage, where these percentages also do not have to be equal. This results in independent, pulse width modulation controlled filament segments. Of course, it is contemplated that filament segments may operate at a different duty cycle instead of the particular 50/50 duty cycle described for illustrative purposes.

As yet another example, presume that input power (e.g., 110-220 VAC input voltage such as 110 VAC@60 Hz) is applied to light source controller 120 where a first set of filament segments (e.g., filament segments $342_2$ and/or $342_3$) operate at 70% duty cycle and a first set of filament segments (e.g., filament segments $342_1$ and/or $342_4$) operate at 30% duty cycle. During 70% of the power cycle, only filament segments $342_2$ and/or $342_3$ may be powered. During the remaining 30% of the cycle, filament segments $342_1$ and/or $342_4$ may be powered, where each filament segment of a set may not be powered equally. This provides different periods of illumination for different filament segments.

Figure 3F:
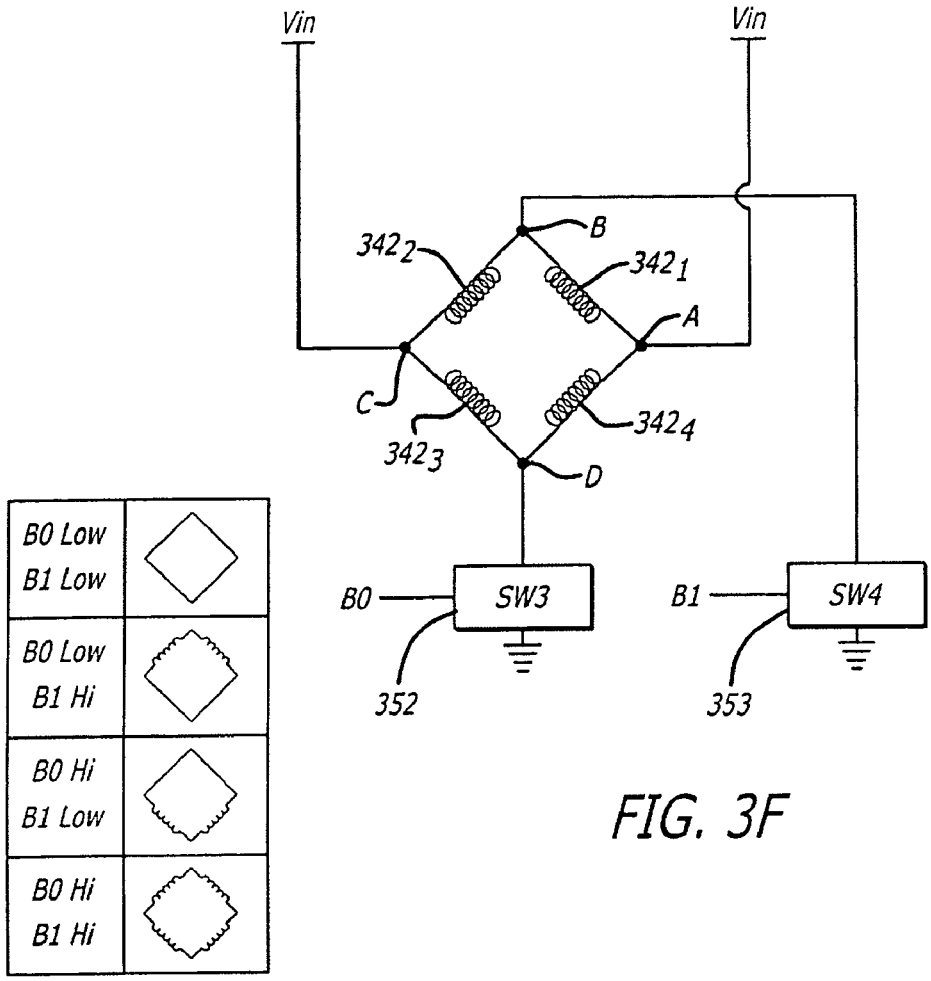
FIG. 3F is a second exemplary schematic diagram of a multi-filament incandescent bulb of FIG. 3A or 3C with two of the filament segments independently controlled.

FIG. 3F is a second exemplary schematic diagram of a multi-filament incandescent bulb of FIG. 3A or 3C with two of the filament segments independently controlled. In contrast with the configuration of FIG. 3E, intersection point A between filament segments $342_1$ and $342_4$ and intersection point C between filament segments $342_2$ and $342_3$ are continuously coupled to input power ($V_{in}$).

As shown, filament segments $342_1$ and $342_2$ are coupled in parallel and filament segments $342_3$ and $342_4$ are coupled in parallel. By activating SW3, SW4, or both, as shown in the operational table of FIG. 3F, each for some percentage of time, independent, pulse width modulation control of groups of filament segments is achieved, namely filament segments $342_1$-$342_2$ and $342_3$-$342_4$ respectively.

Figure 3G:
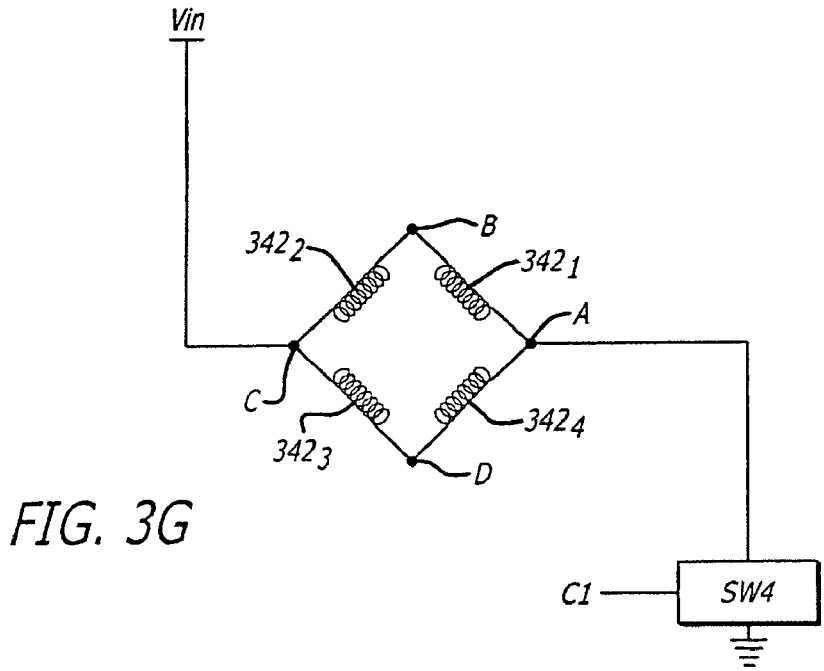
FIG. 3G is a third exemplary schematic diagram of a multi-filament incandescent bulb of FIG. 3A or 3C.

FIG. 3G is a third exemplary schematic diagram of a multi-filament incandescent bulb of FIG. 3A or 3C. As shown, filament segments $342_1$ and $342_2$ are in series and collectively in parallel with filament segments $342_3$ and $342_4$ which are also in series. This produces a light bulb that emulates lighting from a candle flame through PWM of power signals applied to filament segments $342_1$-$342_4$, but may not have a shifting flame effect as set forth in FIGS. 3E and 3F.

In summary, the purpose of this multi-filament bulb structure is to provide a uniform replacement bulb for all types of fixtures. The electronics in the light source controller, namely the existence and control of the switching elements within driver circuitry of the light source controller, dictates the operability of the incandescent light bulb.

Figure 3H:
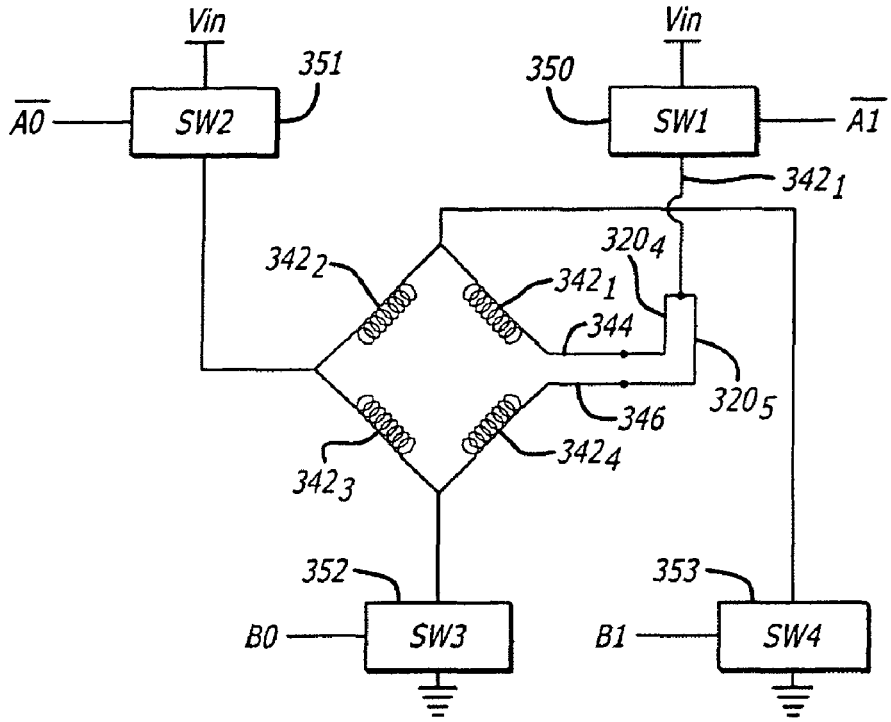
FIG. 3H is a fourth exemplary schematic diagram of a multi-filament incandescent bulb of FIG. 3A or 3C with a each of the four filament segments independently controlled.

FIG. 3H is a fourth exemplary schematic diagram of a multi-filament incandescent bulb of FIG. 3A or 3C with each of the four filament segments independently controlled as described in FIG. 3E. Herein, four filament segments $342_1$-$342_4$ are arranged in an electrically discontinuous polygon shape with no direct coupling of filament segments $342_1$ and $342_4$. Instead, separate ends 344 and 346 of filament segments $342_1$ and $342_4$ are coupled to feedthroughs $320_4$ and $320_5$, respectively. These feedthroughs $320_4$ and $320_5$ may be electrically coupled together outside bulb housing 300 of FIG. 3A or 3C, so that only four feedthroughs $320_1$-$320_4$ are adapted to base 330.

Figure 3I:
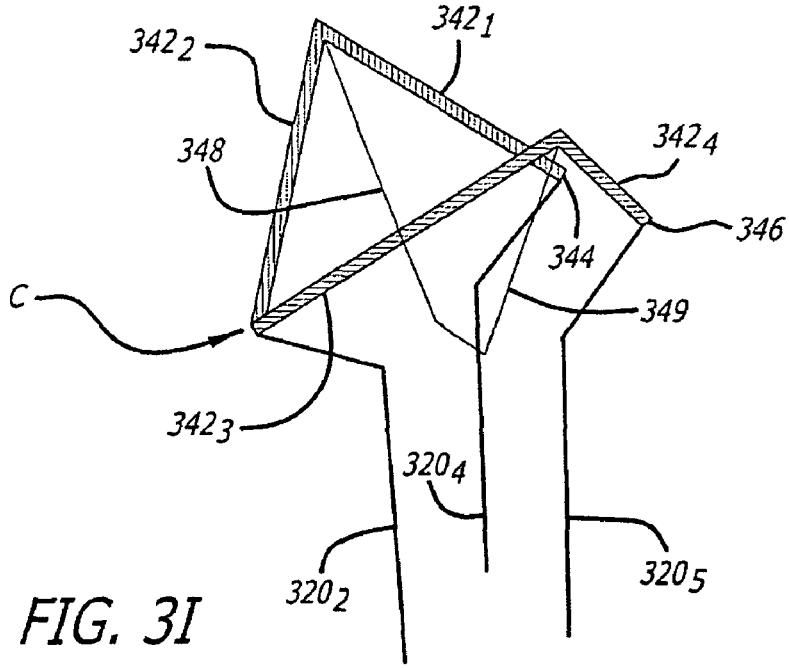
FIG. 3I is a fifth exemplary schematic diagram of multi-filament incandescent bulb of FIG. 3A or 3C with a reduced number of electrical lead wires.

FIG. 3I is a fifth exemplary schematic diagram of multi-filament incandescent bulb of FIG. 3A or 3C with a reduced number of electrical feedthroughs $320_2$, $320_4$ and $320_5$. As shown, electrical feedthroughs $320_2$ would be attached at intersection point C between filament segments $342_2$ and $342_3$. Electrical feedthroughs $320_4$ would be coupled to end 344 of filament segment $342_1$ while electrical feedthrough $320_5$ would be coupled to end 346 of filament segment $342_4$. Non-conductive supports 348 and 349 are arranged to support filament segments $342_1$-$342_4$, where supports 348 and 349 differ from feedthroughs because they remain isolated within bulb housing 300 of FIG. 3A or 3C. These supports 348 and 349 may be made of electrically non-conductive material.

Referring now to FIG. 4A, an exemplary embodiment of a dimmer switch 400 featuring a dimmer controller 405 adapted to control a load 440, such as light source controller 120 and corresponding light source 110 of FIG. 1 for example, in order to emulate lighting from a candle flame. Dimmer controller 405 may have any number of topologies such as a delayed-fired triac architecture as shown in FIG. 4B, or architectures without a triac element such as a variac based wall dimmer and the like.

FIG. 4B is a first exemplary embodiment of the internal components forming dimmer controller 405 of FIG. 4A. According to this embodiment, dimmer controller 405 comprises a variable resistor 410, a capacitor 415, a diac component 420 and a triac component 425. As shown, variable resistor 410 is coupled to capacitor 415 at node E, creating a RC circuit. A first terminal 421 of diac component 420 is coupled to the RC circuit at node E while a second terminal 422 of diac component is coupled to a gate terminal 426 of triac component 425. The remaining terminals 427 and 428 of triac component 425 are coupled to input power ($V_{in}$) and load 440 over a main power line, thereby allowing current ($i_{load}$) to flow to load 440 when gate terminal 426 is activated.

At start-up, triac component 425 is turned off so $i_{load}$ is not flowing to load 440. Instead, a charging current ($i_{charge}$) flows through variable resistor 410 and charges capacitor 415. Once node E reaches a triggering voltage for diac component 420, diac component 420 goes low resistance and conducts, applying a pulse to gate terminal 426. As a result, triac component 425 is turned on to allow $i_{load}$ flows to load 440.

Triac component 425 remains turned on until $i_{load}$ falls below a minimum current threshold. For one embodiment of the invention, where $V_{in}$ is a phase controlled, time-varying power waveform such as AC power signal for example, at every zero crossing of the AC power signal, triac component 425 is turned off because $i_{load}$ would diminish below a current threshold upon reaching the zero crossing and would not be turned on until later in the AC half-cycle.

FIG. 4C is a second exemplary embodiment of a dimmer switch 450 adapted with a candle emulation controller 455 coupled in series with one or more light sources 110 and controlling the light sources in order to emulate lighting produced from a candle flame. According to this embodiment, candle emulation controller 455 is logic combining the functionality of light source controller 120 with a dimmer controller.

For this example, candle emulation controller 455 is coupled in series between power supply 130 and light source 460 through pre-existing power lines 465. Candle emulation controller 455 could be placed into a single housing (not shown) that can be placed into an electrical box previously used by a conventional light switch. This embodiment differs from dimmer switch 400 of FIG. 4A due to the physical separation of the light source controller and light source 460. Herein, light source 460 could be a sconce, porch light or other light that is now controlled to emulate lighting from a candle flame using existing wiring from the electrical box and remotely placed from the light source controller.

Referring to FIG. 5, an exemplary embodiment of a phase controlled, periodic power waveform (also generally referred to as an "input power waveform") 500 supplied from dimmer switch 400 of FIG. 4A is shown. More specifically, for this embodiment, input power waveform 500 is based on a phase controlled, time-varying power waveform such as AC power signal (e.g., e.g., 110-220 volt input such as 110 VAC at 60 Hz). When the user raises or lowers the amount of dimming, the turn-on point of the power shifts back and forth, cutting off some amount of each half-wave of power. In theory, as shown, the voltage amplitude of input power waveform 500 supplied from the delayed-fired triac component is zero is when the RC circuit is charging. In practice, however, there may be a high impedance path through triac component 425 shown in FIG. 4B that would allow the input voltage to drift up toward $V_{in}$ if not pulled down with a resistor or other load. As long as the triac component is turned off, however, only a very small and specified amount of leakage current would flow through the triac component.

At T1 510 (e.g., approximately 2000 microseconds "μs"), the RC circuit has been charged to cause the diac component to turn on the triac component. The voltage amplitude of input power waveform 500 now matches $V_{in}$. Thereafter, it continues to follow AC power signaling until T2 520 (e.g., 8333 μs), where the triac component would be turned off and the RC circuit would begin to recharge.

The data points ($F_i$, where $1 \leqq i \leqq 15$) computed along a time axis 530 illustrate equal area under input power signal 500, which represents equal slices of voltage that can be applied to a light source. For instance, the time difference between data points $F_3$ 540 and $F_4$ 542 is substantially less than the time difference between data points $F_{14}$ 544 and $F_{15}$ 546. The reason is that higher voltages are applied at $F_3$ 540 and $F_4$ 542 than $F_{14}$ 544 and $F_{15}$ 546. Thus, applying one fifteenth (1/15) of the total voltage to the load would require the light source to be turned on for the duration from $F_3$ 540 to $F_4$ 542 or from $F_{14}$ 544 and $F_{15}$ 546 for example.

Figure 6:
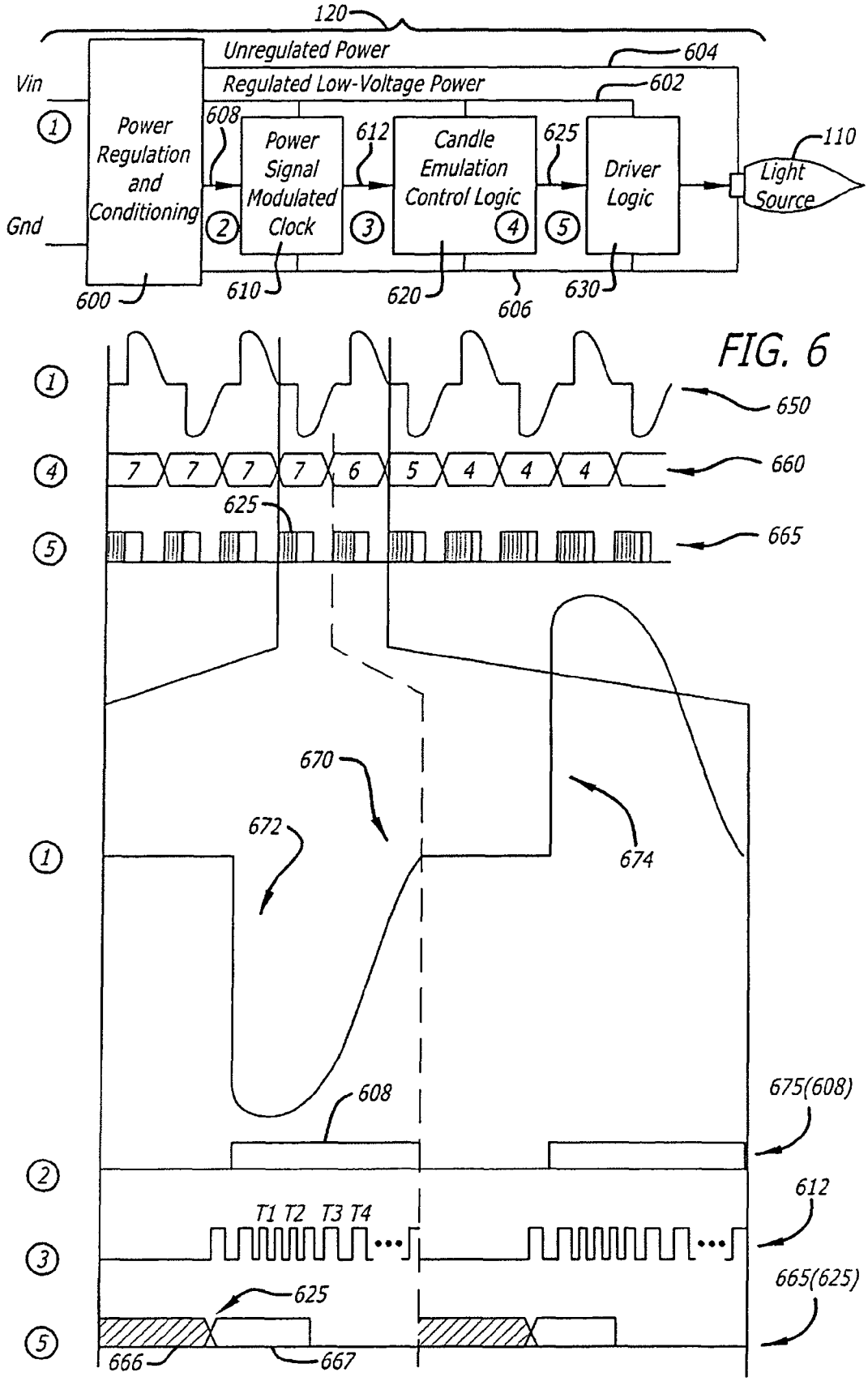
FIG. 6 is a first exemplary embodiment of the light source controller operating with the dimmer switch to control the light source in order to emulate a flickering candle and the signaling received and produced by the light source controller.

Referring now to FIG. 6, a first exemplary embodiment of light source controller 120 operating with a dimmer controller to control a light source in order to emulate lighting from a candle flame and signaling received and produced for a single filament is shown. As shown, for this embodiment, a single light source 110 is controlled by light source controller 120 that comprises power regulation and conditioning logic 600, a power signal modulated clock 610, candle emulation control logic 620 and driver logic 630. It is contemplated, however, that multiple sets of drivers and multiple sets of light sources may be controlled by candle emulation control logic 620, or alternatively, controlled by multiple candle emulation control logic units.

As shown, power regulation and conditioning logic 600 receives input power ($V_{in}$) 650 and ground (GND). $V_{in}$ 650 may be DC power or AC power at any selected duty cycle such as seventy-five percent (75%) as shown. Power regulation and conditioning logic 600 produces both a regulated low voltage power 602 (e.g., 5V, 12V, etc.) and an unregulated voltage power 604, and supplies GND signaling through ground lines 606. Regulated low voltage power 602 is supplied to components of light source controller 120, namely power signal modulated clock 610, candle emulation control logic 620 and driver logic 630. Unregulated voltage power 604 is supplied to light source 110 in order to avoid supplying a substantial amount of regulated voltage to power a high wattage light source such as a 60 W or 100 W incandescent light bulb. Unregulated power 604 may be filtered and/or even a rectified version of $V_{in}$ 650.

Power signal modulated clock 610 receives a control signal 608 from power regulation and conditioning logic 600 that provides information on the timing of the turn-on and turn-off points of triac component 425 for dimmer switch 400 of FIG. 4B. In other words, power signal modulated clock 610 produces a clock 612 that is applied to candle emulation control logic 620 based on information pertaining to $V_{in}$ 650, the input power waveform.

Candle emulation control logic 620 receives clock 612 and outputs pulse width modulated (PWM) signals 625 to driver logic 630. These PWM signals 625 activate and deactivate components of driver logic 630 in order to control light source 110 to emulate lighting from a candle flame. For this embodiment of the invention, candle emulation control logic 620 is outputting values at 50/50 duty cycle such as every half power cycle at 120 HZ if $V_{in}$ is 60 HZ AC power for example. Examples of candle emulation control logic 620 include, but are not limited to an application specific integrated circuit (ASIC), a programmable processor or controller (e.g., microcontroller), a field programmable gate array, combinatorial logic or the like.

For this embodiment, driver logic 630 is configured with switching hardware such as metal-oxcide semiconductor field-effect transistors (MOSFETs), triac components, bipolar junction transistors, or the like. Regardless of the circuitry deployed, the switching hardware is configured to activate and deactivate the load (e.g., various filaments) of the light source.

As further shown in FIG. 6, exemplary embodiments of the signaling received and produced by light source controller 120 are shown. As illustrated, a first waveform 650 illustrates the phase controlled, time-varying, input power waveform ($V_{in}$) that, for this embodiment, is a resultant periodic AC (60 Hz) power signal produced by a delay-fire triac component 425 of FIG. 4B of dimmer switch 400. Although not shown, input power waveform ($V_{in}$) may be a modulated power waveform with a high frequency carrier with appropriate amplitude modulation with polarity switching as produced by electronic transformers. As an example, the carrier would be a high frequency signal and the baseband signal would be first waveform 650.

As further shown, a second waveform 660 illustrates the values being produced internally by candle emulation control logic 620. More specifically, candle emulation control logic 620 receives clock 612 from power signal modulated clock 610 and produces values, which differ or are equal in width every power half-cycle of the input power waveform (e.g., at 120 Hz). These values are used to identify a particular amount of voltage applied to the load. For instance, where a power half-cycle constitutes fifteen (15) time slices, the value "7" indicates that 7/15 of the voltage available is applied to the load.

A third waveform 665 is the actual value being multiple PWM signals 625 output to driver logic 630 of FIG. 6. Herein, waveform 665 is active-high, and thus, components of driver logic 630 are activated when waveform 665 is logic high and are deactivated when waveform 665 is logic low.

As still shown in FIG. 6, a detailed perspective of a power cycle of input power waveform ($V_{in}$) and certain resultant signals produced by components of light source controller 120 are shown. For instance, waveform 670 is a detailed illustration of a single power cycle of first waveform 650 having a first power half-cycle 672 and a second power half-cycle 674.

A waveform 675 is representative of control signal 608 from power regulation and conditioning logic 600 that provides information on the timing of the turn-on and turn-off points of the dimmer switch's triac component. It is contemplated that waveform 675 may have an analog format. Waveform 675 merely provides information to power signal modulated clock 610 regarding $V_{in}$ such as when is power being turned on and turned off, how much power is available at a certain time, and the like.

A portion of clock 612 generated by power signal modulated clock 610 is further shown. The purpose of clock 612 is to clock candle emulation control logic 620 in such a way that the varying input voltage is being adjusted for terms of the time that the output is activated.

Herein, the periodicity of clock 612 is varied based on the input power waveform 670. More specifically, clock 612 is frequency modulated by input power waveform 670 such that clock 612 experiences a higher frequency when input power waveform 670 has a higher amplitude, and experiences a lower frequency when input power waveform 670 has lower amplitude. In other words, clock 612 is more compressed the higher the voltage amplitude of input power waveform 670.

For this illustrative embodiment, the clock pulse widths at time T1 and T2 are substantially narrower than the clock pulse widths at times T3 and T4. In other words, the periods of the clock cycles vary. It is noted that, for one embodiment of power signal modulated clock 610, a predetermined number of clock pulses (e.g., approximately 240 clock pulses) are provided for each power half-cycle 672 or 674. For each power half-cycle, candle emulation control logic 620 outputs a series of PWM output signals (referred to as "PWM frame"), and thus, by altering the clock pulses, the PWM output signals may be adjusted accordingly.

A more detailed illustration of a portion of third waveform 665 is shown. This portion illustrates the actual output to driver logic 630 where, in a first region 666 of waveform 665, the triac component 425 in the dimmer switch is not activated. However, driver logic 630 continues to receive power and continue to charge the RC circuit in the dimmer switch. As soon triac component 425 is set as shown in region 667, candle emulation control logic 620 waits for a programmed time period (e.g., 7/15 of power half-cycle) until light source 110 is to be turned off. At that time, power is turned off and an appropriate amount of time is waited until the power is turned on (e.g., around zero-crossing of input power waveform 670) so that the RC circuit is allowed to operate correctly.

FIG. 7 is a first exemplary embodiment of the operations performed by power signal modulated clock 610 of FIG. 6. This embodiment involves computing time-varying clock periods at approximately 50/50 duty cycle, such as over each half-cycle of input power waveform 700 (Sin(ωt)) as illustrated therein. Of course, estimation and use of tables rather than iterative computations may simplify the computations.

At start time ($t_0$), a time when the dimmer switch turns on or certain number of clocks after, "n" clocks need to be provided before the end of the power half-cycle (T/2). The period 710 of the next clock pulse is set to be equal to the difference of "x" (to be computed) and $t_0$.

Therefore, an integral is taken from time $t_0$ to time "x" of input power waveform (Sin(ωt)) 700 and it is set equal to one-$n^{th}$ of the full amount of remaining power 720 that is remaining, being the power of the half-cycle from time $t_0$ to time "T/2". Hereafter, time "x" is computed and this iterative process is used to compute the period of the next clock pulse. Of course, tables may be used to provide estimated values in order to reduce the computational intensity required by power signal modulated clock 610 of FIG. 6.

Figure 8A:
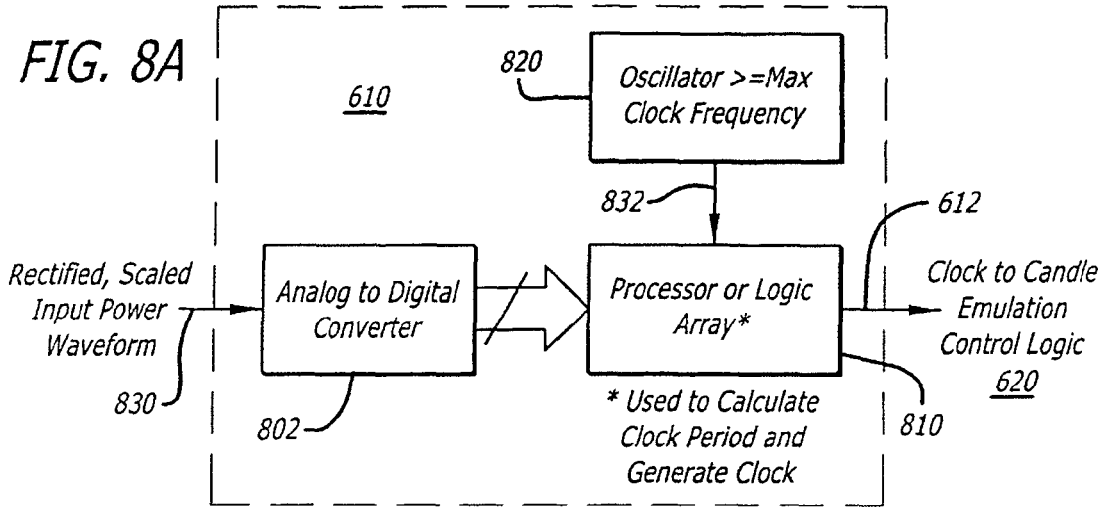
FIG. 8A is an exemplary embodiment of the components associated with the power signal modulated clock of FIG. 6.

FIG. 8A is an exemplary embodiment of components implemented within power signal modulated clock 610 of FIG. 6. Power signal modulated clock 610 comprises an analog-to-digital (A/D) converter 800, processing logic 810 and an optional oscillator 820. Herein, A/D converter 800 receives a rectified, scaled input power waveform 830 and measures the amount of voltage associated therewith. Based on the measured voltage levels of power waveform 830, processing logic 810 computes clock 612, which is a frequency modulated clock signal formed as a collective of clock pulses varying in time so that each clock period is associated with a substantial equal amount of measured voltage of input power waveform 830. As an optional feature, oscillator 820 is adapted to provide a base clock 832 to processing logic 810, where base clock 832 would oscillate at a frequency greater than the maximum clock frequency of clock 612. It is contemplated, of course, that processing logic 810 may be asynchronous logic, thereby not requiring any external clocking signals from oscillator 820.

Figure 8B:
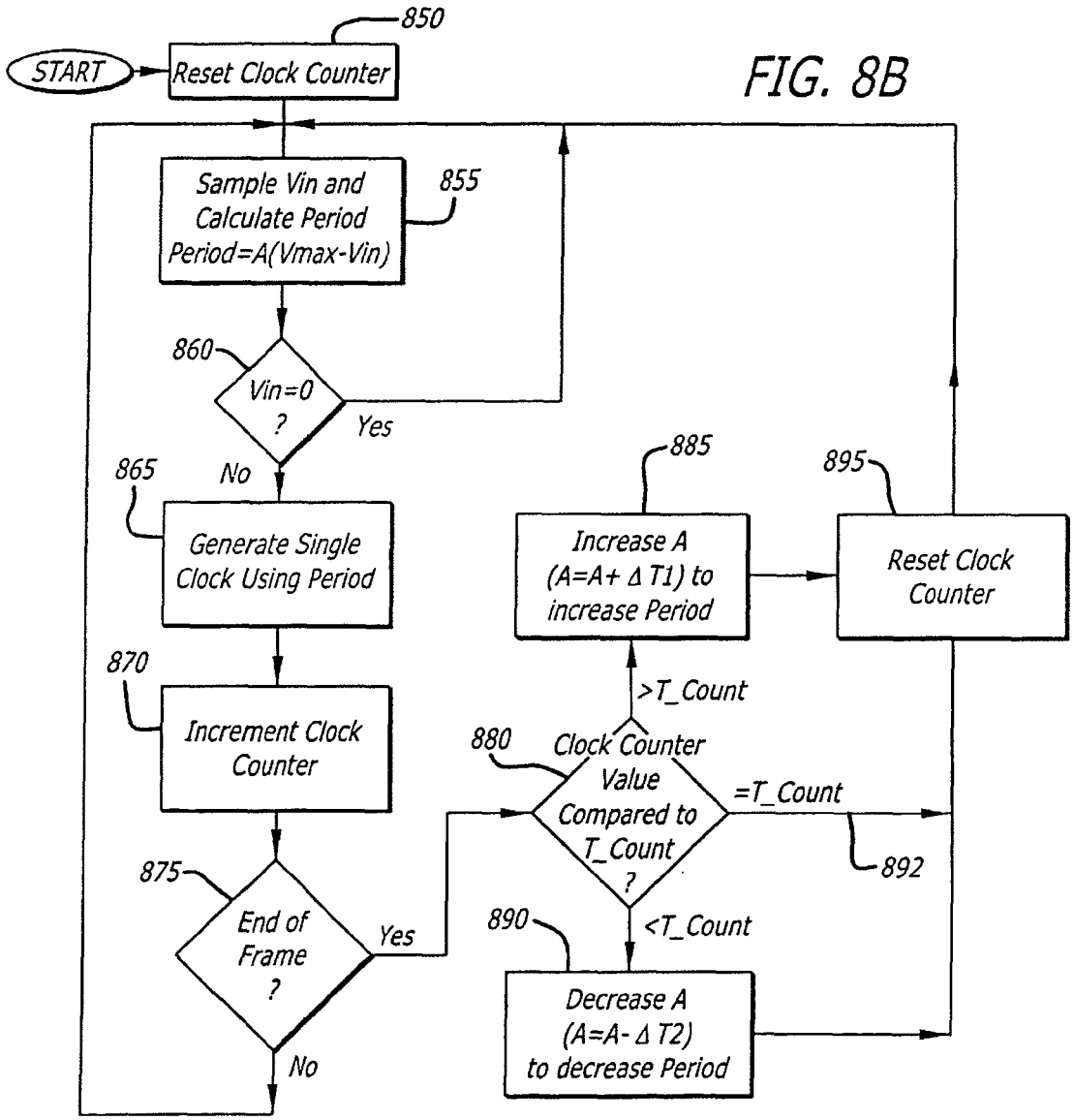
FIG. 8B is a second exemplary embodiment of the operations performed by the power signal modulated clock as shown in FIGS. 6 and 8A.

Referring now to FIG. 8B, a second exemplary embodiment of the operations performed by power signal modulated clock 610 of FIGS. 6 and 8A is shown. For this embodiment, "$V_{in}$" is considered to be an input AC power waveform that is used to produce a frequency modulated clock signal.

Initially, a clock counter is reset and $V_{in}$ is sampled to calculate a new period (PERIOD) according to Equation 1 (see blocks 850 and 855):

Equation 1:

$$\text{PERIOD}=A(V_{max}-V_{in}), \text{ where}$$

"A" is a predetermined amplitude;

"$V_{max}$" is a maximum voltage for the input power waveform; and

"$V_{in}$" is the sampled voltage of the input power waveform.

For this illustrative embodiment, as shown in block 860, a determination is made whether $V_{in}$ is a non-zero value (or alternatively reaches a predetermined minimum threshold voltage where $V_{in} \geqq |V_{min}|$). If so, a single clock is generated using the predetermined clock period and the clock counter is incremented (blocks 865 and 870). Otherwise, a wait state occurs and $V_{in}$ is measured again.

Next, a determination is made whether $V_{in}$ has fallen below a minimum voltage threshold ($V_{in} < |V_{min}|$) "$V_{min}$" may be a programmable value or a preset, static value. As an example, where $V_{in}$ is a 110 volts (@60 Hz) power waveform, $V_{min}$ may be set at five (5) volts for example. As another example, $V_{in}$ is any power waveform based on any voltage, most likely ranging between 110-220 volts in accordance with U.S. and International standards. The purpose of this determination is to detect an end of PWM frame (block 875).

In the event that an end of the PWM frame has not been detected, $V_{in}$ is sampled and a new period (PERIOD) is calculated according to Equation 1 above. As a result, successive clock signals for the PWM frame are frequency modulated based on the measured voltage of $V_{in}$.

In the event that an end of the PWM frame is detected, the count value is compared to a predetermined targeted count value (T_COUNT) as shown in block 880. If the count value is greater than T_COUNT, the period of the power cycle is increased by a first amount of time (ΔT1) as shown in block 885. In contrast, if the count value is less than T_COUNT, the period of the power cycle is decreased by a second amount of time (ΔT2), where ΔT1 may or may not be equal to ΔT2 (block 890). If the count value is equal to T_COUNT, the period remains unchanged (block 892). For all of these determinations, the method of operation returns to block 855 after the clock counter is reset and the beginning of a new power cycle is monitored.

FIG. 9 is a second exemplary embodiment of light source controller 120 operating with the dimmer switch to control a light source in order to emulate lighting from a candle flame and of the signaling received and produced by the light source controller. As shown, for this embodiment, light source controller 120 comprises power regulation and conditioning logic 900, a fixed frequency oscillator 910, candle emulation control logic 620, power signal compensation logic 920 and driver logic 630.

As previously described, the first exemplary embodiment of light source controller 120 (FIG. 6) involved generation of a frequency modulated clock based on characteristics of the input power waveform and supplied the clock to candle emulation control logic 620 to produce appropriate PWM signals to driver logic 630. In contrast, the second exemplary embodiment as described below features fixed frequency oscillator 910 being used to clock candle emulation control logic 620 and separate circuitry, namely power signal compensation logic 920, to adjust the timing of the PWM signals applied to driver logic 630.

Herein, according to one embodiment of the invention, power regulation and conditioning logic 900 receives an input power waveform ($V_{in}$) 905 and Ground signaling (GND). $V_{in}$ 905 may be DC power or AC power at approximately seventy-five percent (75%) as shown. Power regulation and conditioning logic 900 produces both regulated low voltage power 907 (e.g., 5V, 12V, etc.) and unregulated voltage power 908, as well as supplies GND 909. Regulated low voltage power 907 is supplied to oscillator 910, candle emulation control logic 620 and driver logic 630. Unregulated voltage power 908 is supplied to light source 110. GND 909 is applied to oscillator 910, candle emulation control logic 620, power signal compensation logic 920, driver logic 630 and light source 110.

In contrast with the operations of FIG. 6, power regulation and conditioning logic 900 provides information 930 on the timing of the turn-on and turn-off points of components within the dimmer switch (e.g., triac component) to power signal compensation logic 920. A fixed or constant frequency clock signal 915 is provided from oscillator 910 to candle emulation control logic 620, which provides values 932 that are used to identify a particular amount of voltage applied to light source 110.

Power signal compensation logic 920 receives values 932, and in combination with timing information 930 supplied by power registration and conditioning logic 900, outputs pulse width modulated (PWM) signals 935 to driver logic 630. PWM signals 935 are used to activate and deactivate components of driver logic 630 in order to emulate lighting from a candle flame. For this embodiment, power signal compensation logic 920 is outputting PWM signals at 50/50 duty cycle (e.g., every power half-cycle at 120 HZ if $V_{in}$ is 60 HZ AC power).

Referring still to FIG. 9, a detailed perspective of a power cycle of input power waveform ($V_{in}$) and certain resultant signals produced by components of light source controller 120 are shown. As illustrated, waveform 940 is a segment of a single power cycle of $V_{in}$ 905. Waveform 930 is a signal from power regulation and conditioning logic 900 that provides information on the timing of the turn-on and turn-off points of a triac component to power signal compensation logic 920.

As further shown, the actual output to driver logic 630 where, in a first region 950 of PWM signal 935, a selected component (e.g., triac) in the dimmer switch is inactive. However, driver logic 630 continues to receive power and allow current to pass through light source 110 so that the RC charging circuit in the dimmer continues to operate. As soon the triac component is set at second region 952, the candle emulation control logic 620 waits for a programmed time period (e.g., 7/15 of power half-cycle) until light source 110 is to be turned off. At that time, power is turned off and an appropriate amount of time is waited until the power is turned on (e.g., around zero-crossing of input power waveform 940).

It is important to note that the waveforms applied to driver logic 630 are substantially equivalent as the waveforms applied to driver logic of FIG. 6. It occurs at a point that light source controller 120 has knowledge of power input waveform 905 and adjusts the output accordingly.

As set forth below, Equation 2 illustrates a first exemplary embodiment of the operations performed by the power regulation and conditioning circuitry 900 of FIG. 9. This embodiment involves the computation of "x" for each clock cycle, where "x" identifies when power is disconnected from the light source.

EQUATION 2:

Ton=point in time when dimmer triac turns on x=point at which power is disconnected from bulb T=period of AC waveform, for 60 Hz, 16666 ms n=PWM value for this frame N=total PWM values in a frame, i.e. for 4-bit PWM, values can be 0-15, so N=16.

$$\int_{Ton}^{x} \sin(\omega t)dt = n/N \int_{Ton}^{T/2} \sin(\omega t)dt$$

$$\omega = 2\pi/T$$

By adjusting the integral boundaries, the following is obtained:

$$\int_{y}^{T/2-Ton} \sin(\omega t)dt = n/N \int_{0}^{T/2-Ton} \sin(\omega t)dt$$

$$y = T/2 - x$$

$$\omega = 2\pi/T$$

Now remember that $$\int \sin(\omega t)dt = -1 - \omega\cos(\omega t)$$

$$\cos(0) = 1$$

$$\cos(\pi) = -1$$

$$\cos(2\pi) = 1$$

To solve this equation for y:

$$-1/\omega\cos(\omega t)\Big|_{y}^{T/2-Ton} = -n/N\omega\cos(\omega t)\Big|_{0}^{T/2-Ton}$$

$$y = 1/\omega * a\cos\left[\left(1-\frac{n}{N}\right)\cos(\omega(T/2-Ton))+\frac{n}{N}\right]$$

$$x = T/2 - 1/\omega * a\cos\left[\left(1-\frac{n}{N}\right)\cos(\omega(T/2-Ton))+\frac{n}{N}\right]$$

For verification, we know $$0 \leqq Ton \leqq T/2$$

$$\Rightarrow T/2 \geqq T/2 - Ton \geqq 0$$

$$\Rightarrow 1 \geqq \cos(\omega(T/2-Ton)) \geqq -1$$

As Ton ranges from 0 to T/2

At Ton=0:

$$x = T/2 - 1/\omega * a\cos\left[\frac{2n-N}{N}\right]$$

$$n = 0 \rightarrow x = 0$$

$$n = N \rightarrow x = T/2$$

And at Ton=T/2

$$x = T/2 - 1/\omega * a\cos(0) = T/2$$

Figure 10A:
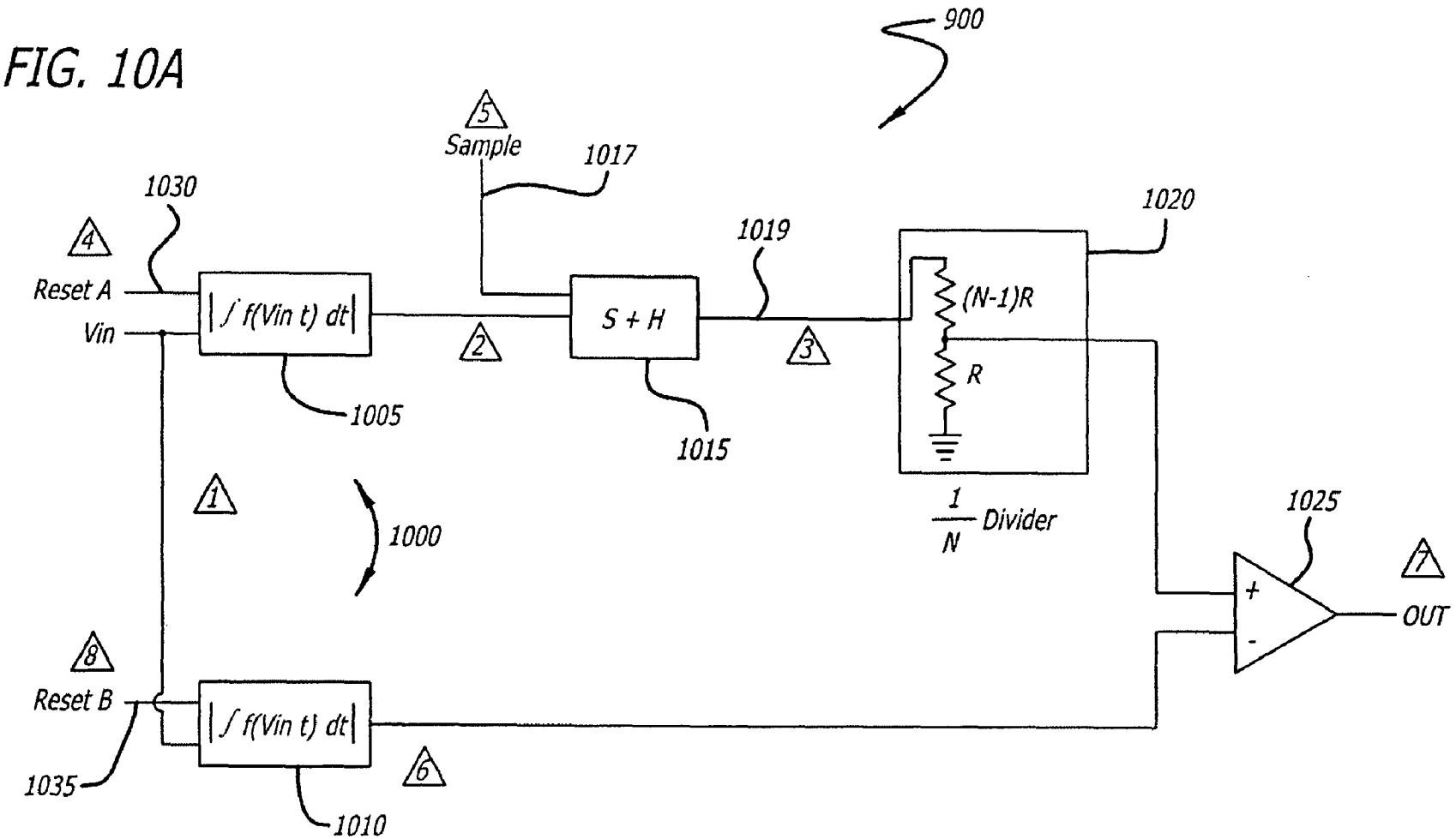
FIG. 10A is an exemplary embodiment of the operations performed by the power regulation and conditioning circuitry of FIG. 9.

FIG. 10A is an illustrative embodiment of power regulation and conditioning logic 900 operating with a dimmer controller to control the light source in order to emulate lighting from a candle flame. According to one embodiment of the invention, Power signal compensation logic 920 comprises one or more integrators 1000 (e.g., first and second integrators 1005 and 1010), a sample & hold circuit 1015, a divider (e.g., resistor ladder circuit, variable divider) 1020 and a comparator 1025. Integrators 1005 and 1010 may be implemented in software or in hardware (e.g., analog circuitry) and can be reset as needed. The analog inputs to both integrators 1005 and 1010 may be connected to the unregulated input power, Vin or alternatively to a regulated, rectified, protected and/or scaled version of Vin.

Figure 10B:
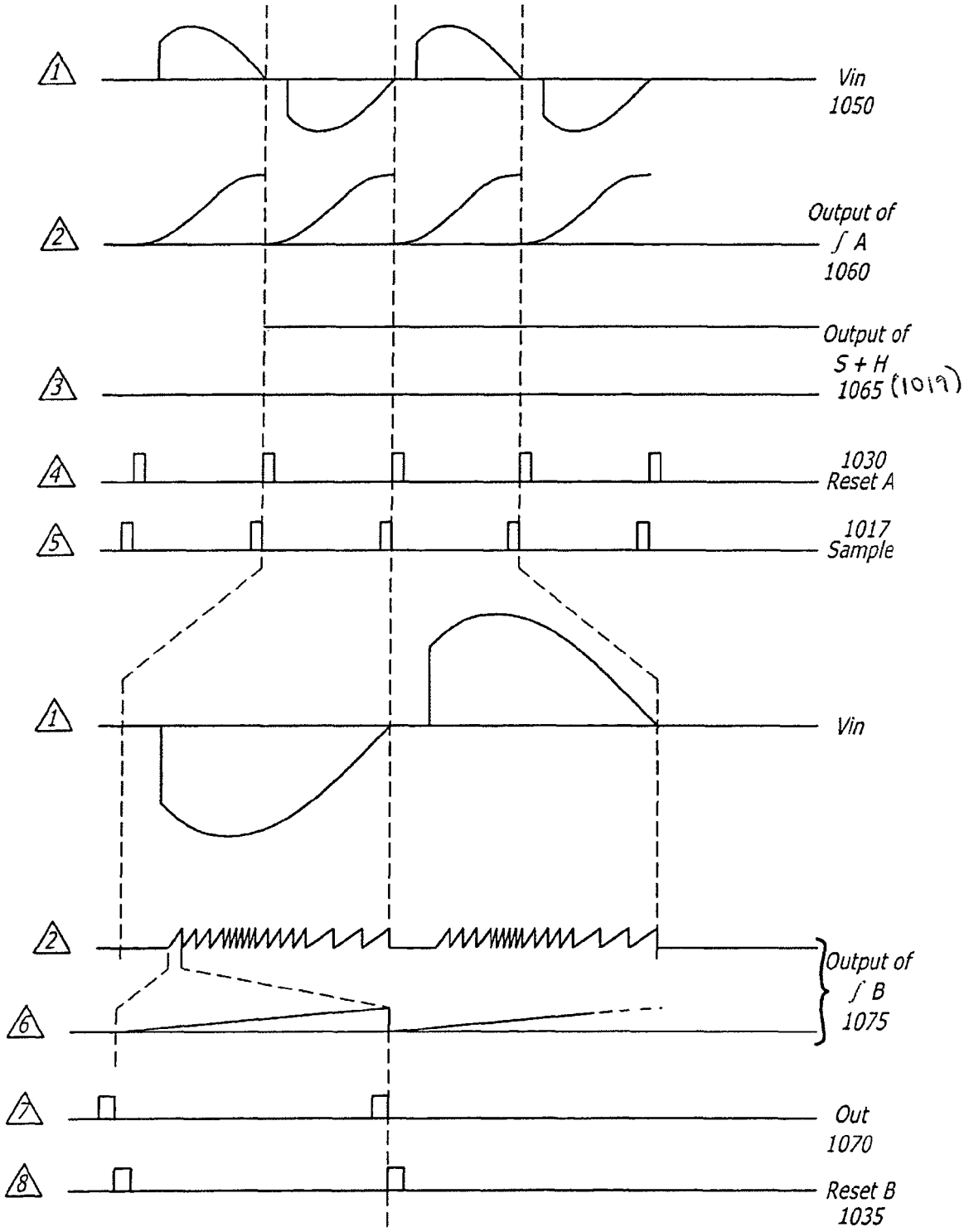
FIG. 10B are exemplary embodiments of the signaling received and produced by power regulation and conditioning circuitry in accordance with FIG. 10A.

According to one embodiment, as further shown in FIG. 10B, first integrator 1005 is adapted to measure voltage available over a 50/50 duty cycle (e.g., over an entire power half-cycle). Second integrator 1010 is adapted to measure up to a predetermined ratio (X/Y, where "X" and "Y" are integers and X≦Y) of voltage available during the power half-cycle. In other words, second integrator 1010 is used to measure a ratio of overall power available (e.g., $1/16^{th}$ of $V_{in}$, where X=1, Y=16) as measured in a prior power half-cycle by first integrator 1005. Hence, the output of second integrator 1010 is more compressed and has a lesser amplitude than signaling measured at the output of first integrator 1005.

In general, first and second integrators 1005 and 1010 can collectively map out equal amounts of voltage through integration of a function based on an input power waveform ($V_{in}$) and time (t). The sampled, integrated voltage originating from first integrator 1005 is subsequently divided out by divider 1020 for comparison with the voltage measured by second integrator 1010. Of course, it is contemplated that first integrator 1005 may be adapted as a "X/Y" integrator to allow removal of divider 1020.

As shown in FIG. 10A, when triggered by a sample pulse 1017, sample & hold circuit 1015 samples an output signal of first integrator 1005 and holds it on its output 1019. Hence, every time sample pulse 1017 is asserted, sample & hold circuit 1015 measures the resultant output of first integrator 1005 at that time. As a result, use of first integrator 1005 with sample & hold circuit 1015 is an iterative process where $V_{in}$ undergoes integration, a sample is measured and then first integrator 1005 receives a reset signal 1030 to restart integration for the next power half-cycle.

Comparator 1025 identifies when the output of second integrator 1010 is equivalent to the predetermined ratio (X/Y) of the total power as measured first integrator 1005, namely when a particular data points on the time axis in FIG. 5 is reached. Thereafter, the process repeats for the next time slice of the input power waveform $V_{in}$.

FIG. 10B is an exemplary embodiment of the operations performed by power regulation and conditioning circuitry 900 of FIG. 9. These operations are performed every power cycle (e.g., 60 Hz) rather than every clock cycle, reducing the process intensity.

Herein, a first waveform 1050 is a selected duty cycle of an input power waveform ($V_{in}$) where the dimmer has not been adjusted during this time frame. Second waveform 1060 is the resultant output measured on first integrator 1005, which is the result of integrating the power available on a power half-cycle previous to the power half-cycle at which second integrator 1010 is operating.

Waveform 1065 represents a sampled output representing an instantaneous voltage measured for the end of a power half-cycle and is held for comparison with the measured voltage by second integrator 1010. This sampled output is held at the output 1019 of sample & hold circuit 1015 of FIG. 10A, which occurs approximate to the end of each power half-cycle. Hence, as shown herein, sample pulse 1017 occurs prior to reset signal 1030 for first integrator 1005. This provides a steady value on sample and hold circuit 1015 from which to compare.

As shown, the resulting output of second integrator 1010 occurs at a much higher frequency because a lesser output value needs to be realized before reset signal 1035 is set. Moreover, as the voltage amplitude of $V_{in}$ increases, the rate of integration increases in speed.

Waveform 1070 is the output of comparator 1025 of FIG. 10A, which indicates that that saw-tooth waveform output measured by second integrator 1010 has reached 1/16 of the total voltage of input power waveform ($V_{in}$) measured by integrator 1005. As a result, the output is logic high to indicate the following: (1) the output 1075 of second integrator has reached $1/16^{th}$ of the total voltage of input power waveform ($V_{in}$), and (2) second integrator 1010 needs to be reset 1035. As soon as second integrator 1010 is reset, the output drops to zero again and starts ramping up again.

Figure 11A:
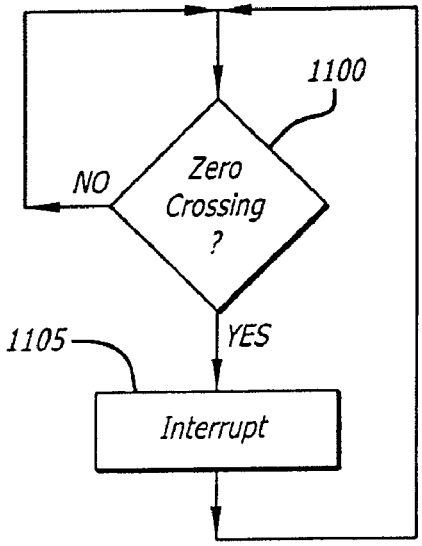
FIGS. 11A and 11B are exemplary flowcharts of the operations of the power regulation and conditioning circuitry of FIG. 9.

FIG. 11A is an exemplary flowchart of the operations of the power regulation and conditioning logic of FIG. 9. In order to maintain the flow of operations, an interrupt should be generated upon detection of a zero crossing (block 1100). This may be accomplished by a variety of mechanisms. For instance, the zero crossing may be detected by implementing a zero crossing detector within power regulation and conditioning circuitry 900 of FIG. 9. Alternatively, the zero crossing may be detected by code executing on a processing logic in communication with power regulation and conditioning logic 900 of FIG. 9.

If this is the first zero crossing detected, an interrupt is generated to cause a secondary operation to occur (block 1105). Otherwise, the operations continue to monitor for a zero crossing.

Figure 11B:
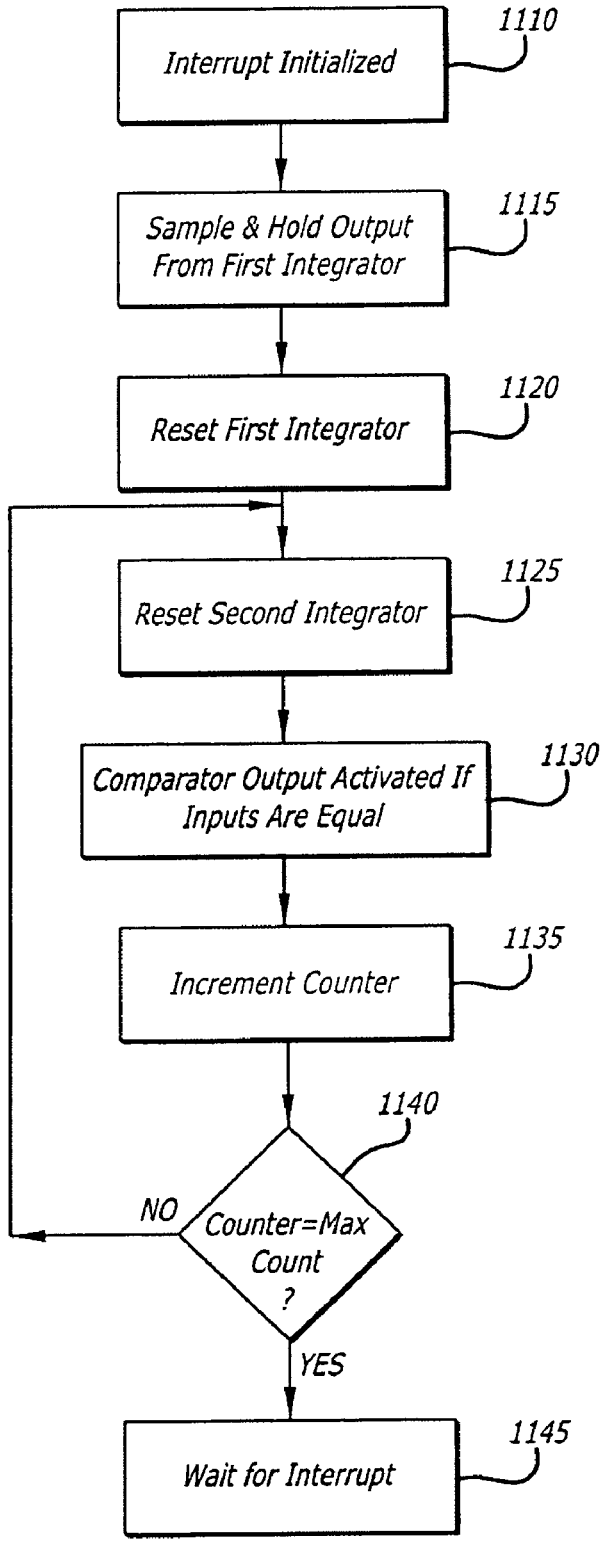

As shown in FIG. 11B, an exemplary flowchart of the operations of the power regulation and conditioning logic of FIG. 9 upon detection of a zero crossing is shown. Upon detection of a zero crossing and initiation of the interrupt, the sample & hold circuitry samples the total voltage of a previous input power waveform (blocks 1110 and 115). The first and second integrators are reset, so as to begin integration for this power cycle (blocks 1120 and 1125).

Now, the second integrator commences integration until it achieves and output equal to X/Y (e.g., 1/16 of the output of first integrator). At that time, the comparator outputs a logic high signal and a counter is incremented (blocks 1130 and 1135). The counter is used to control activation and deactivation of the light source for a given pulse width modulated frame and to track the position within the PWM frame. In particular, the counter controls the light source such that if the count is equal to one and it is desired that the light source be illuminated $1/16^{th}$ of the time, certain filament segments of the light source are turned on. Then, a determination is made whether the maximum count has been reached (block 1140). If the counter has not reached the maximum count, the second integrator is reset and commences integration again as set forth in blocks 1125-1140). If we have reached the maximum count, a waiting period occurs until a new interrupt is issued (block 1145).

FIG. 12 is a third exemplary embodiment of light source controller 120 operating with the dimmer control to control light source 110 in order to emulate lighting from a candle flame and of the signaling received and produced by light source controller 120. As shown, for this embodiment, light source controller 120 comprises power regulation and conditioning logic 1200, synchronized oscillator 1210, candle emulation control logic 620 and driver logic 630.

As shown, power regulation and conditioning logic 1200 receives an input power waveform ($V_{in}$) 1250 and Ground signaling (GND). $V_{in}$ may be DC power or AC power as shown. Power regulation and conditioning logic 1200 produces both regulated low voltage power 1202 (e.g., 5V, 12V, etc.) and unregulated voltage power 1204, as well as supplies GND 1206. Regulated low voltage power 1202 is supplied to synchronized oscillator 1210, candle emulation control logic 620 and driver logic 630. Unregulated voltage power 1204 is supplied to light source 110. GND 1206 is applied to synchronized clock 1210, candle emulation control logic 620, driver logic 630, and light source 110.

Herein, synchronized oscillator 1210 applies a substantially constant clock 1215 to candle emulation control logic 620. Clock 1215 may have a fixed number of clock cycles per power half-cycle (e.g., 240 clock cycles per power half-cycle). Synchronized oscillator 1210 may be separate from or integrated within candle emulation control logic 620.

Unlike other embodiments, at no point does any component of light source controller 120 need information regarding the voltage amplitude of input power ($V_{in}$). Instead, during each cycle of the input power waveform, $V_{in}$ is divided into small segments of time during which the input power appears to be linear or constant between neighboring segments.

A first waveform 1250 is an input power ($V_{in}$) waveform, which is approximately a 75% duty cycle. An expanded version of a single power cycle is further shown below. Although shown as a AC sinusoidal waveform, it is contemplated that waveform 1250 may be a modulated power waveform with a high frequency carrier with appropriate amplitude modulation with polarity switching.

A second waveform 1255 features values produced internally within candle emulation control logic 620, which are used to identify a particular amount of voltage applied to the load.

Regarding a third waveform 1260, a falling edge 1262 of second waveform 1260 is illustrated along with the shaded area 1264 of waveform 1260, which merely represents that the structure of second waveform 1260 is not critical to the operations of the candle emulation device. Only a periodic reference of waveforms for each power half-cycle, such as the timing between falling edges of neighboring waveforms is pertinent information provided by power regulation and conditioning logic 1200.

A fourth waveform 1270 is a high frequency clock signal that is synchronized to the input power and maintains a fixed (and perhaps constant) number of cycles unless the frequency of $V_{in}$ is altered. In essence, small slices of input power waveform 1250 over time are being taken and input power waveform 1250 is not changing that much over each slice. Thus, input power waveform 1250 appears as a DC signal that is pulse width modulated. Unlike FIG. 6, there is no clock adjustment for the amplitude of $V_{in}$ because candle emulation control logic 620 is updating once every power half-cycle.

A fifth waveform 1280 features the output PWM signals applied to light source 110. These output PWM signals are equal in width and change based on modifications of values within second waveform 1255. As shown, first power half-cycle 1252 is divided into Z (e.g., $Z \geqq 16$) segments where the output PWM signals are repeated for each segment. In other words, for the first power half-cycle, a first PWM signal 1282 would represent $7/16^{th}$ of the total time associated with the particular time slice (T/2Z). "Z" is chosen based on a number of constraints: (1) intermittent application of power to the load is fast enough to avoid the dimmer being accidentally turned off (e.g., triac component turned off); (2) sufficient in number so that there is substantially equal power levels between neighboring segments; (3) minimal in number to avoid an unnecessarily high driver logic activation and deactivation frequency, which causes inefficient power consumption.

Figure 13:
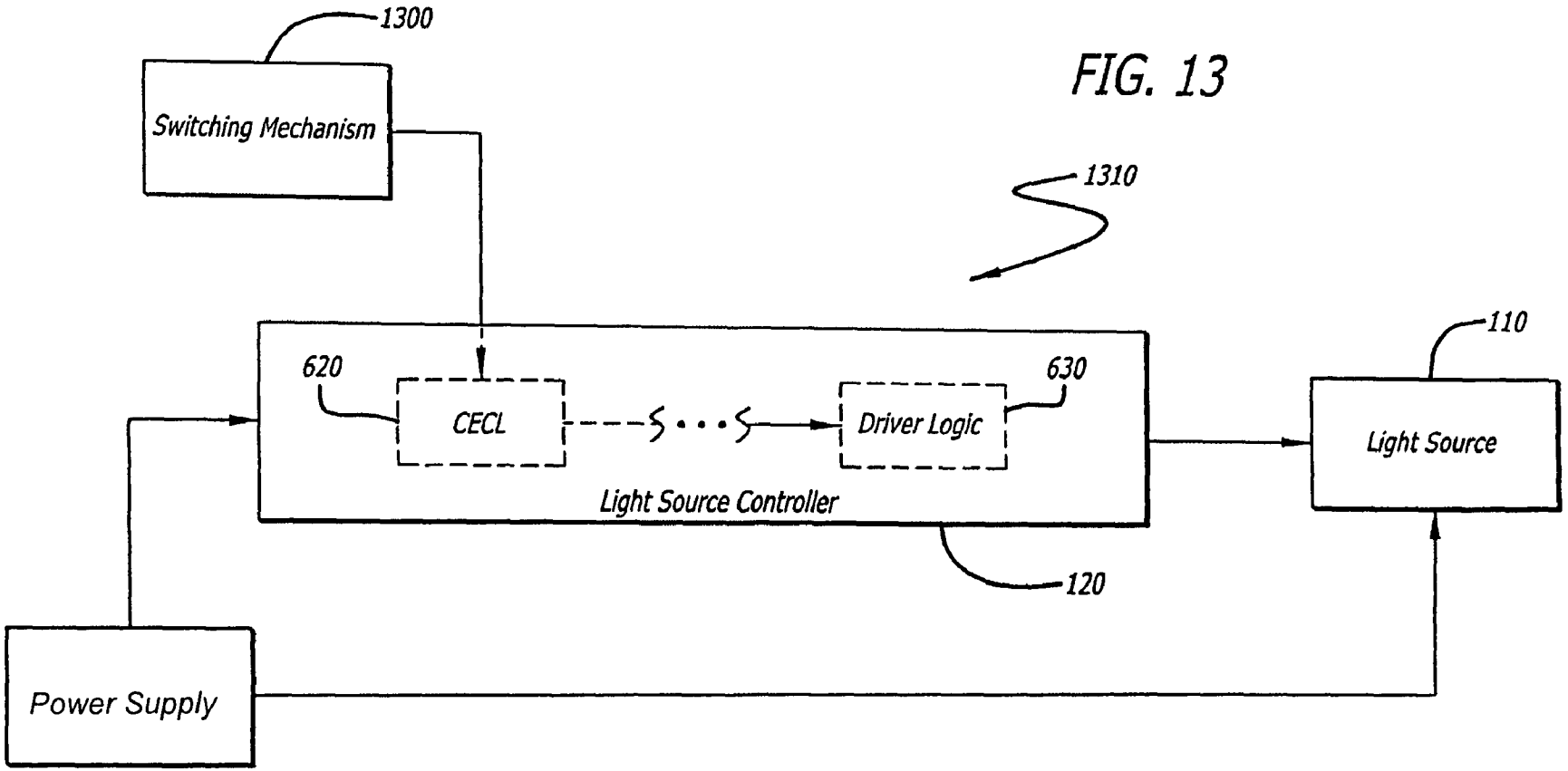
FIG. 13 is an exemplary block diagram illustrating mode switching controlled by light source controller 120 of FIG. 1.

FIG. 13 is an exemplary block diagram illustrating mode switching at least partially controlled by light source controller 120 of FIG. 1. Light source controller 120 is adapted to place light source 110 in a variety of lighting modes. These lighting modes may include, but are not limited or restricted to one or more candle modes and/or one or more non-candle modes. Of course, it is contemplated that light source controller 120 may have a single mode of operation with multiple sub-modes as described.

In general, a "first mode" (non-candle mode) involves substantially constant illumination, which is the typical lighting effect produced by lighting fixtures using incandescent light bulbs (i.e. constant lighting). The first mode may have one or more sub-modes, each of which represents different illumination levels (dim/brightness levels), which may be useful for dimmer application or power savings.

A "second mode" (candle mode) is a mode of operation that emulates the lighting effect produced by a candle flame. More specifically, the second mode may also include one or more sub-modes, each representing a different type of lighting pattern produced by a candle flame. For instance, various candle (emulation) sub-modes may produce lighting patterns representing a glowing lighting effect, a flickering lighting effect (e.g., windy —candle in high wind with increased flickering rate; calm —candle in low wind with minimal flickering rate, etc.), a random lighting effect, a pulsating lighting effect where the light intensity routinely changes dramatically, a shifting effect where the physical location of the light appears to vary, or the like. It is contemplated that lighting modes and sub-modes described herein are merely illustrative, and not restrictive. Other lighting modes and sub-modes may be utilized by the invention.

The placement of light source controller 120 into a first mode or a second mode may be controlled by a switching mechanism 1300 accessible to the consumer. Examples of switching mechanism 1300 may include, but are not limited or restricted to a dimmer/light switch, a separate manual switch, a remote control or the like. For instance, the separate manual switch may be located on the housing of a lighting fixture (candle emulation device) 1310 that is implemented with light source controller 120. A consumer manually adjusts switching mechanism 1300 to signal candle emulation control logic (CECL) 620 of light source controller 120 as to the desired lighting mode.

For instance, switching mechanism 1300, when implemented as a light switch, may be turned on/off, perhaps multiple times, in order to program a default lighting mode, and/or place light source 110 into a particular lighting mode. The programming of the default lighting mode may be to any available lighting mode, regardless of the lighting mode that was previously used.

Based on the chosen setting of switching mechanism 1300 corresponding to a chosen mode of operation, CECL 620 generates a particular sequence of values that are subsequently used by CECL 620 as shown or perhaps power signal compensation logic of FIG. 9, to produce PWM output signals applied to driver logic 630. These PWM output signals are used to control activation and deactivation of filament segment(s) of light source 110, which produces the selected lighting effect.

Alternatively, switching mechanism 1300 may control placement of light source controller 120 into a first mode or second mode by a cyclical setting of the lighting modes. For instance, lighting fixture 1310 operates in a first mode and, upon an occurrence of a mode-switching event, lighting fixture 1310 may be configured to operate in another mode or a particular sub-mode. As an example, upon re-occurrence of a mode-switching event, candle emulation device 1310, previously operating in a first mode, now operates in a second sub-mode of the second mode. Hence, the selection of the lighting modes is performed serially and is dependent on either the prior lighting mode used or a selected default lighting mode (where a consumer selects how a light should respond whenever it is turned on from being off for a short amount of time).

Herein, a "mode-switching event" is any action that causes a change of state from one lighting mode to another. For instance, manual adjustment of a switch or dial associated with lighting modes placed on candle emulation device 1310 constitutes a mode-switching event. Additionally, pushing a button placed on lighting fixture 1310 to sequentially alter the lighting mode constitutes a mode-switching event. As another example, causing an interrupt in power (turning off/on a lighting fixture within selected period of time, or lowering the duty cycle of a dimmed input power wave to a certain threshold, followed by raising it) constitutes a mode-switching event. Also, control signaling from external control logic or even a solar cell, as X10 signaling over power line, or RF signal over air constitutes a mode-switching event.

Although not shown, it is further contemplated that a single light source (e.g., light source 110 of FIG. 1) may be controlled by both light source controller 120 when candle emulation is desired or by other components when normal incandescent lighting (i.e., substantially constant illumination) is desired. More specifically, implemented within a lighting fixture, switching logic may be configured to support three or more operational states. A first state is an OFF state where light source 110 is not illuminated. The switching logic may be placed in a second state where a light source controller (as described above) is adapted to control the mode of operation of light source 110 in order to emulate the lighting effect produced by a candle flame. In addition, the switching logic may be placed in a third state where power is directly supplied to light source 110 bypassing the light source controller. In the third state, the light source provides substantially constant illumination. The switching logic would be controlled and placed into one of these operational states through use of a switching mechanism as described above.

Also, it is further contemplated that multiple light sources within a single lighting fixture may be separately controlled by a light source controller (defined above) and other components that are adapted to control and enable substantially constant illumination. For this configuration, one or more switches (located internally within the lighting fixture and/or externally within a wiring scheme) support three operational states. A first state is an OFF state where neither of the light sources is illuminated. A second state is where the light source controller is allowed to control the mode of operation of a first light source in order to emulate the lighting effect produced by a candle flame. Finally, a third state supplies power to enable substantially constant illumination of a second light source. Hence, when the lighting fixture is operational, the switch is controlled so that either the first light source provides illumination that emulates the lighting effect of a candle flame or the second light source provides substantially constant illumination (normal incandescent lighting).

While the invention has been described in terms of several embodiments, the invention should not be limited to only those embodiments described, but can be practiced with modification and alteration within the spirit and scope of the appended claims. The description is thus to be regarded as illustrative instead of limiting.

What is claimed is:

1. A method comprising:

receiving a time-varying power waveform; and outputting a pulse width modulated (PWM) signal to a light source in order to produce a lighting effect emulating lighting from a candle flame, the PWM signal being synchronized with the time-varying power waveform, the outputting of the PWM signal comprises producing a control signal based on the time-varying power waveform, and producing the PWM signal based on the control signal, the PWM signal activates and deactivates components of a driver logic in order to control the light source into producing the lighting effect.

2. The method of claim 1, wherein the outputting of the PWM signal further comprises producing a clock signal based on the control signal and producing the PWM signal based on the clock signal.

3. The method of claim 1, wherein the PWM signal is altered based on a signal output from a dimmer switch.

4. The method of claim 1, wherein the PWM signal is synchronized and compressed within the time-varying power waveform.

5. The method of claim 1, wherein the producing of the clock signal includes modulating a frequency of the clock signal by the control signal.

6. The method of claim 1, wherein the producing of the clock signal includes modulating a frequency of the clock signal by the input power waveform.

7. The method of claim 6, wherein the PWM signal based on the clock signal is produced by a candle emulation control logic being an application specific integrated circuit (ASIC).

8. The method of claim 1, wherein the outputting of the PWM signal further comprises:

producing regulated power by power regulation and conditioning logic, the regulated power being supplied to a clock source adapted to produce the clock signal, a candle emulation control logic adapted to produce the PWM signal, and the driver logic.

9. The method of claim 8, wherein the outputting of the PWM signal further comprises:

producing unregulated power by the power regulation and conditioning logic, the unregulated power being the supplied to the light source.

10. A method comprising:

receiving a time-varying power waveform; and outputting a pulse width modulated (PWM) signal to a light source in order to produce a lighting effect emulating lighting from a candle flame, the PWM signal being synchronized with the time-varying power waveform, wherein the outputting of the PWM signal comprises:

producing timing information based on the time-varying power waveform, producing values that are used to identify a particular amount of power applied to the light source based on a constant frequency clock signal, and producing the PWM signal based on the values and the timing information.

11. The method of claim 10 further comprising:

using the PWM signal to control components of driver logic that controls activation of the light source.

12. A method comprising:

receiving a time-varying power waveform; and outputting a pulse width modulated (PWM) signal to a light source in order to produce a lighting effect emulating lighting from a candle flame, the PWM signal being synchronized with the time-varying power waveform, the outputting of the PWM signal comprises:

producing a first waveform being a high frequency clock signal that is synchronized to the time-varying power waveform, producing a second waveform including values to identify a particular amount of power applied to the light source, and producing output PWM signals forming the PWM signal, the output PWM signals are equal in width and change based on modifications of values within second waveform.

13. A candle emulation device comprising:

a light source; and a light source controller coupled to the light source, the light source controller to receive a time-varying power waveform and to produce a pulse width modulated (PWM) signal that is used to control the light source in order to produce a lighting effect that emulates lighting from a candle flame, the light source controller comprises:

power regulation and conditioning logic to provide regulated, local power from unregulated input power, candle emulation control logic coupled to the power regulation and conditioning logic, the candle emulation control logic to produce a sequence of signals to create the lighting effect, and driver logic coupled to the power regulation and conditioning logic and the candle emulation logic, the driver logic to control the light source based on the sequence of signals supplied by the candle emulation control logic.

14. The candle emulation device of claim 13, wherein the light source controller is adapted to place the light source into a first mode where the lighting effect emulates lighting from a candle flame and a second mode where the light source has substantially constant illumination.

15. The candle emulation device of claim 13 further comprising a power source at least coupled to the light source controller to supply the unregulated input power.

16. The candle emulation device of claim 13, wherein the driver logic to activate or deactivate different filament segments of the light source.

17. The candle emulation device of claim 13, wherein the light source comprises:

a bulb housing including a translucent material surrounding a plurality of filament segments, the bulb housing includes a first closed end and a second open end including an elongated protrusion formed proximate to a perimeter of the second open end to create a channel;

a plurality of feedthroughs coupled to the plurality of filament segments and extending through the second open end of the bulb housing; and a base interlocking with the channel of the bulb housing and being coupled to the light source controller, the base including a first plurality of grooves alternatively positioned on a top and bottom surfaces of the base to expose multiple locations of surface area of the plurality of feedthroughs.

18. The candle emulation device of claim 13 being a chandelier with the light source controller positioned within a frame of the chandelier and producing the PWM signal to control multiple light sources each producing a lighting effect that emulates lighting from the candle flame.

19. The candle emulation device of claim 13, wherein the time-varying power waveform being an output from a dimmer switch external to the candle emulation device.

20. A candle emulation device comprising:

a light source; and a light source controller coupled to the light source, the light source controller to receive a time-varying power waveform and to produce a pulse width modulated (PWM) signal that is synchronized with the time-varying power waveform in order to produce a lighting effect that emulates lighting from a candle flame, the light source controller comprises:

a power regulation and conditioning logic to produce a control signal based on the time-varying power waveform, a power signal modulated clock coupled to the power regulation and conditioning logic, the power signal modulated clock to produce a clock signal based on the control signal, a driver logic to electrically coupled to the light source, and a candle emulation control logic coupled to the power signal modulated clock and the driver logic, the candle emulation control logic to produce the PWM signal based on the clock signal, the PWM signal activates and deactivates components of the driver logic in order to control the light source into producing the lighting effect.

21. The candle emulation device of claim 20, wherein the light source controller to receive the time-varying power waveform from a dimmer switch external to the candle emulation device.

22. A candle emulation device comprising:

a light source; and a light source controller coupled to the light source, the light source controller to receive a time-varying power waveform and to produce a pulse width modulated (PWM) signal that is synchronized with the time-varying power waveform in order to produce a lighting effect that emulates lighting from a candle flame, the light source controller comprises:

a power regulation and conditioning logic to produce a timing information based on the time-varying power waveform, a clock to produce a clock signal with a fixed clock frequency, a driver logic to electrically coupled to the light source, a candle emulation control logic coupled to the clock and the driver logic, the candle emulation control logic to producing values that are used to identify a particular amount of power applied to the light source based on the clock signal, and a power signal compensation logic coupled to the power regulation and conditioning logic and the candle emulation control logic, the power signal compensation logic to produce the PWM signal based on the values and the timing information.

23. The candle emulation device of claim 22, wherein the light source controller to receive the time-varying power waveform from a dimmer switch external to the candle emulation device.

24. A candle emulation device comprising:

a light source; and a light source controller coupled to the light source, the light source controller to receive a time-varying power waveform and to produce a pulse width modulated (PWM) signal that is synchronized with the time-varying power waveform in order to produce a lighting effect that emulates lighting from a candle flame, the light source controller comprises:

a driver logic to electrically coupled to the light source, and a candle emulation control logic coupled to the driver logic, the candle emulation control logic to produce output PWM signals forming the PWM signal, the output PWM signals are substantially equal in width for each power half-cycle and are used to control the light source to produce the lighting effect.

25. The candle emulation device of claim 24, wherein the light source controller to receive the time-varying power waveform from a dimmer switch external to the candle emulation device.

* * * * *